US009033449B1

(12) United States Patent
Shikama et al.

(10) Patent No.: US 9,033,449 B1
(45) Date of Patent: May 19, 2015

(54) RECORDING APPARATUS

(71) Applicant: Brother Kogyo Kabushiki Kaisha, Nagoya-shi, Aichi-ken (JP)

(72) Inventors: Yasuhito Shikama, Nagoya (JP); Kohei Terada, Kiyosu (JP); Shinya Yamamoto, Nagoya (JP); Akihito Kobayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/580,980

(22) Filed: Dec. 23, 2014

(30) Foreign Application Priority Data

Dec. 27, 2013 (JP) ..... 2013-271991

(51) Int. Cl.

| | |
|---|---|
| ***B41J 29/38*** | (2006.01) |
| ***B41J 13/00*** | (2006.01) |
| ***B65H 5/06*** | (2006.01) |
| ***B41J 3/60*** | (2006.01) |
| ***B41J 13/22*** | (2006.01) |

(52) U.S. Cl.
CPC ..... *B41J 13/0009* (2013.01); *B65H 5/06* (2013.01); *B41J 3/60* (2013.01); *B41J 13/223* (2013.01)

(58) Field of Classification Search
CPC ..... B65H 5/06; B41J 3/60; B41J 13/223
USPC ..... 347/16, 101, 104; 271/270, 273
See application file for complete search history.

(56) References Cited

U.S. PATENT DOCUMENTS

| | | | | |
|---|---|---|---|---|
| 6,345,170 | B1 * | 2/2002 | Nakazato et al. | 399/388 |
| 8,899,572 | B2 * | 12/2014 | Gotoda | 271/4.02 |
| 8,915,494 | B2 * | 12/2014 | Samoto et al. | 271/10.11 |

FOREIGN PATENT DOCUMENTS

| | | |
|---|---|---|
| JP | 2002-302329 | 10/2002 |
| JP | 2005-199541 | 7/2005 |
| JP | 2012-240343 | 12/2012 |

* cited by examiner

*Primary Examiner* — An Do
(74) *Attorney, Agent, or Firm* — Frommer Lawrence & Haug LLP

(57) ABSTRACT

A recording apparatus includes: first and second recording modules; a storage accommodating a recording medium; a first path extending from the storage to the first recording module; and a second path extending from the storage to the second recording module and including a shared portion shared with the first path. A trailing edge of a recording medium for which recording is being performed by the first recording module on a leading edge of a recordable area is located upstream of a branch position on the first path. When recording is being performed by the second recording module on a trailing edge of a recordable area of a recording medium, the trailing edge of the recording medium on which the recording is being performed by the first recording module is located downstream of the branch position on the first path and a module path of the first recording module.

6 Claims, 15 Drawing Sheets

RECORDING APPARATUS

CROSS REFERENCE TO RELATED APPLICATION

The present application claims priority from Japanese Patent Application No. 2013-271991, which was filed on Dec. 27, 2013, the disclosure of which is herein incorporated by reference in its entirety.

BACKGROUND

1. Technical Field

The present invention relates to a recording apparatus including a plurality of recording modules.

2. Description of the Related Art

There is known a recording apparatus including a plurality of recording modules. Each of the recording modules includes a recording device configured to record an image on a recording medium. For example, in a printer including two recording modules arranged vertically, each of a conveying distance L1 between a branch point of a shared conveyance path and a recording starting position of a first carriage on a first conveyance path and a conveying distance L2 between the branch point and a recording starting position of a second carriage on a second conveyance path is set to be longer than or equal to the length of the maximum size sheet which can be used in the printer.

SUMMARY

In the conventional printer, in a case where a long sheet or recording medium in a sheet conveying direction is used in the above-described settings, each of the distances L1, L2 needs to be longer accordingly, resulting in increase in the size of the apparatus. In the conventional printer, on the other hand, recording is performed on a sheet longer than each of the distances L1, L2 not based on the above-described settings while keeping the size of the apparatus, it is possible to consider that when a first image forming device is recording an image on a trailing edge of a recordable area on a sheet, a trailing edge of a sheet on which recording is being performed by a second image forming device is located upstream of the branch point on the conveyance path. In this case, the next sheet cannot be supplied to the first image forming device until the trailing edge of the sheet on which recording is being performed by the second image forming device is moved to a position located downstream of the branch point, making it difficult to improve a throughput.

This invention has been developed to provide a recording apparatus capable of achieving both of downsizing of the apparatus and improvement of a throughput.

The present invention provides a recording apparatus including: a plurality of recording modules each including a module path and a recording device configured to perform recording on a recording medium conveyed along the module path, the plurality of recording modules including a first recording module and a second recording module different from the first recording module; a storage configured to accommodate the recording medium; a first path through which a recording medium is to be conveyed from the storage to the module path of the first recording module; a second path through which a recording medium is to be conveyed from the storage to the module path of the second recording module, the second path including, at an upstream portion thereof, a shared portion shared with the first path, the second path being branched off from the first path at a branch position located at an end portion of the shared portion; a switcher configured to switch, at the branch position, a destination of the recording medium between the first path and the second path; a shared conveyor configured to convey the recording medium at the shared portion; a sensor configured to output a signal indicating presence or absence of the recording medium at a sensing position located on the shared portion; and a controller configured to control the plurality of recording modules, the switcher, and the shared conveyor. The first path and the module path of the first recording module are configured such that a trailing edge of a recording medium for which recording is being performed by the first recording module on a leading edge of a recordable area is located upstream of the branch position on the first path. The first path and the module path of the first recording module are configured such that when recording is being performed by the second recording module on a trailing edge of a recordable area of a recording medium, the trailing edge of the recording medium on which the recording is being performed by the first recording module is located downstream of the branch position on the first path and the module path of the first recording module. The controller is configured to execute: a determination processing in which the controller determines, based on the signal output from the sensor, whether the trailing edge of the recording medium on which the recording is being performed by the first recording module is located downstream of the branch position on the first path; and a supply processing in which when the controller has determined, in the determination processing, that the trailing edge of the recording medium is located downstream of the branch position on the first path, the controller controls the switcher and the shared conveyor to supply a recording medium from the storage to the second recording module along the second path via the shared portion and the branch position such that a leading edge of the recording medium passes through the branch position by a time the recording on the trailing edge of the recordable area of the recording medium is completed by the second recording module.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

Figure 1:
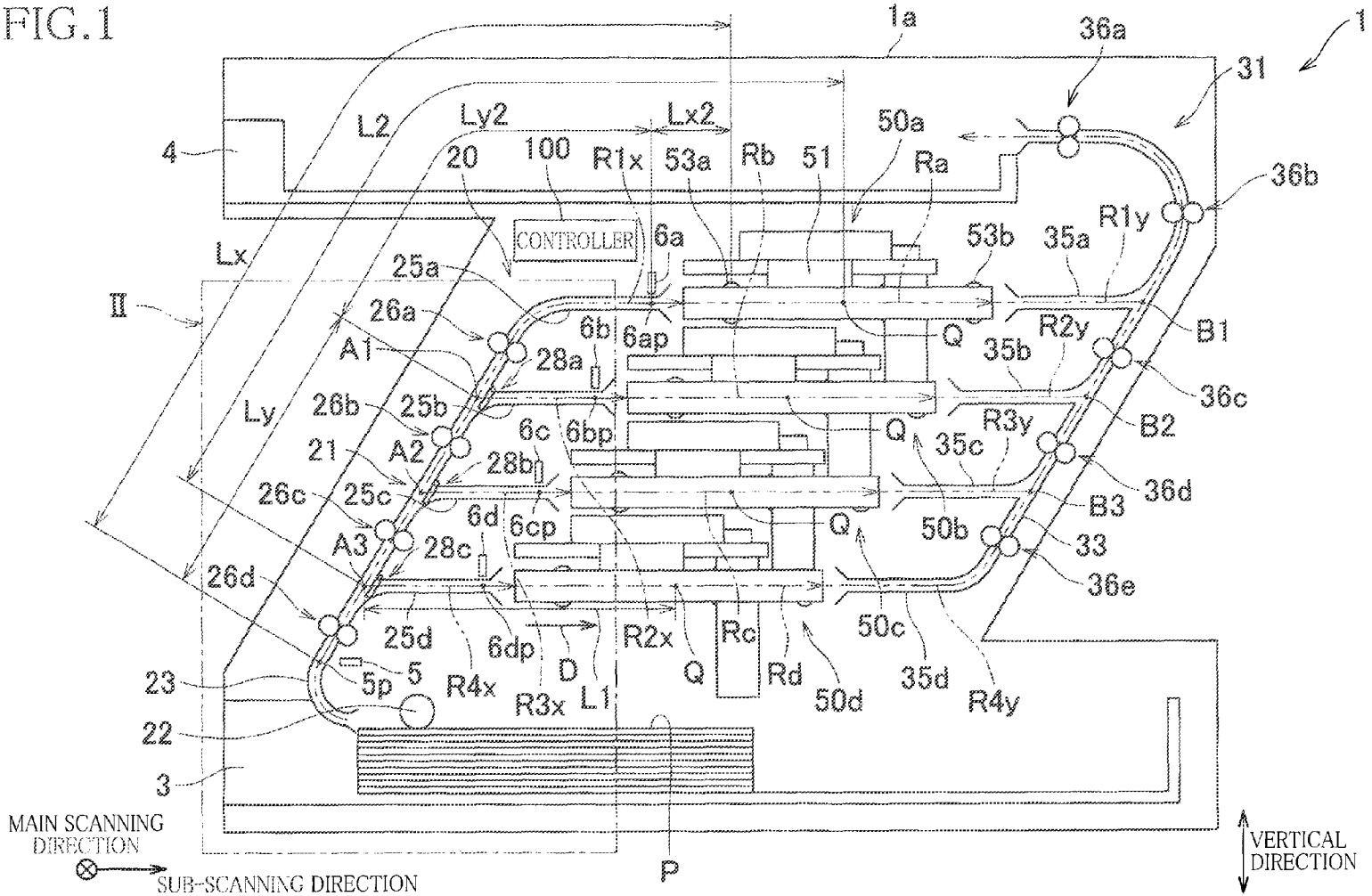
FIG. 1 is a schematic side view illustrating an internal structure of an ink-jet printer according to a first embodiment of the present invention.

Hereinafter, there will be described embodiments of the present invention by reference to the drawings.

First, there will be explained an overall configuration of an ink-jet printer 1 according to a first embodiment of the present invention with reference to FIG. 1.

The printer 1 includes a housing 1*a* having a Z-shape in cross section. Devices and components arranged in the housing 1*a* include recording modules 50*a*-50*d*, a conveying unit 20, a sheet storage 3, a sheet receiver 4, and a controller 100.

The recording modules 50*a*-50*d* are arranged in the vertical direction. A recording module 50*a* is the farthest from the sheet storage 3 and the nearest to the sheet receiver 4 among the recording modules 50*a*-50*d*. The recording module 50*d* is the nearest to the sheet storage 3 and the farthest from the sheet receiver 4 among the recording modules 50*a*-50*d*.

The recording modules 50*a*-50*d* have the same construction and each includes a head 51 as one example of a recording device. Four cartridges, not shown, are mountable on and removable from the housing 1*a*. Each of the cartridges stores black ink and is connected to a corresponding one of the heads 51 by a tube and a pump. The controller 100 drives the pump to supply the ink from the cartridge to the head 51 through the tube.

The conveying unit 20 is configured to convey a sheet P as one example of a recording medium from the sheet storage 3 to the sheet receiver 4 via any one of the module paths Ra-Rd formed in the respective recording modules 50*a*-50*d*.

The conveying unit 20 includes an upstream unit 21 and a downstream unit 31. The upstream unit 21 has paths R1x-R4x through which the sheet P is conveyed from the sheet storage 3 to the respective module paths Ra-Rd. The downstream unit 31 has paths R1y-R4y through which the sheet P is conveyed from the downstream end portions of the respective module paths Ra-Rd to the sheet receiver 4.

The paths R1x-R4x extend from the sheet storage 3 to the respective upstream end portions of the module paths Ra-Rd. The paths R1x, R2x extend from the sheet storage 3 to a branch position A1 by the same route and branch off at the branch position A1 so as to extend to the module paths Ra, Rb, respectively. The paths R2x, R3x extend from the sheet storage 3 to a branch position A2 by the same route and branch off at the branch position A2 so as to extend to the module paths Rb, Rc, respectively. The paths R3x, R4x extend from the sheet storage 3 to a branch position A3 by the same route and branch off at the branch position A3 so as to extend to the module paths Rc, Rd, respectively. The branch position A1 is a position of a boundary between a shared portion of the paths R1x, R2x and a non-shared portion of the paths R1x, R2x. The branch position A2 is a position of a boundary between a shared portion of the paths R2x, R3x and a non-shared portion of the paths R2x, R3x. The branch position A3 is a position of a boundary between a shared portion of the paths R3x, R4x and a non-shared portion of the paths R3x, R4x.

The upstream unit 21 includes a sheet-supply roller 22, roller pairs 26*a*-26*d*, guides 23, 25*a*-25*d*, and switchers 28*a*-28*c*.

The sheet-supply roller 22 is disposed so as to contact an uppermost one of the sheets P stored in the sheet storage 3. The controller 100 drives a sheet-supply motor 22M (see FIG. 6) to rotate the sheet-supply roller 22. This rotation supplies the uppermost sheet P from the sheet storage 3.

Each of the roller pairs 26*a*-26*d* has two rollers contacting each other and conveys the sheet P, with the two rollers nipping the sheet P therebetween. One of the two rollers of each of the roller pairs 26*a*-26*d* is a drive roller which is rotated by an upstream conveying motor 26M (see FIG. 6) driven by the controller 100. The other of the two rollers of each of the roller pairs 26*a*-26*d* is a driven roller which is rotated, in a direction reverse to a direction of the rotation of the drive roller, by the rotation of the drive roller while contacting the drive roller. As a result, the sheet P supplied by the sheet-supply roller 22 from the sheet storage 3 is conveyed to any one of the module paths Ra-Rd. The roller pairs 26*a*-26*d* are driven in synchronization with each other by the upstream conveying motor 26M.

Each of the guides 23, 25*a*-25*d* defines a corresponding one or ones of the paths R1x-R4x and includes a pair of plates arranged spaced apart from each other. The guides 25*a*-25*d* extend in the horizontal direction and define the respective downstream portions of the paths R1x-R4x. The guide 23 extends obliquely with respect to the vertical direction and defines the upstream portions of the respective paths R1x-R4x. The guide 25*a* is connected to the other end portion of the guide 23 from the sheet storage 3, and the guides 25*b*-25*d* are connected to the guide 23 other than its end portions.

The switchers 28*a*-28*c* are respectively arranged at the branch positions A1-A3. The switcher 28*a* at the branch position A1 switches a destination of the sheet P between the path R x and the path R2x. The switcher 28*b* at the branch position A2 switches a destination of the sheet P between one of the paths R1x, R2x and the path R3x. The switcher 28*c* at the branch position A3 switches a destination of the sheet P between one of the paths R1x-R3x and the path R4x.

Figure 2:
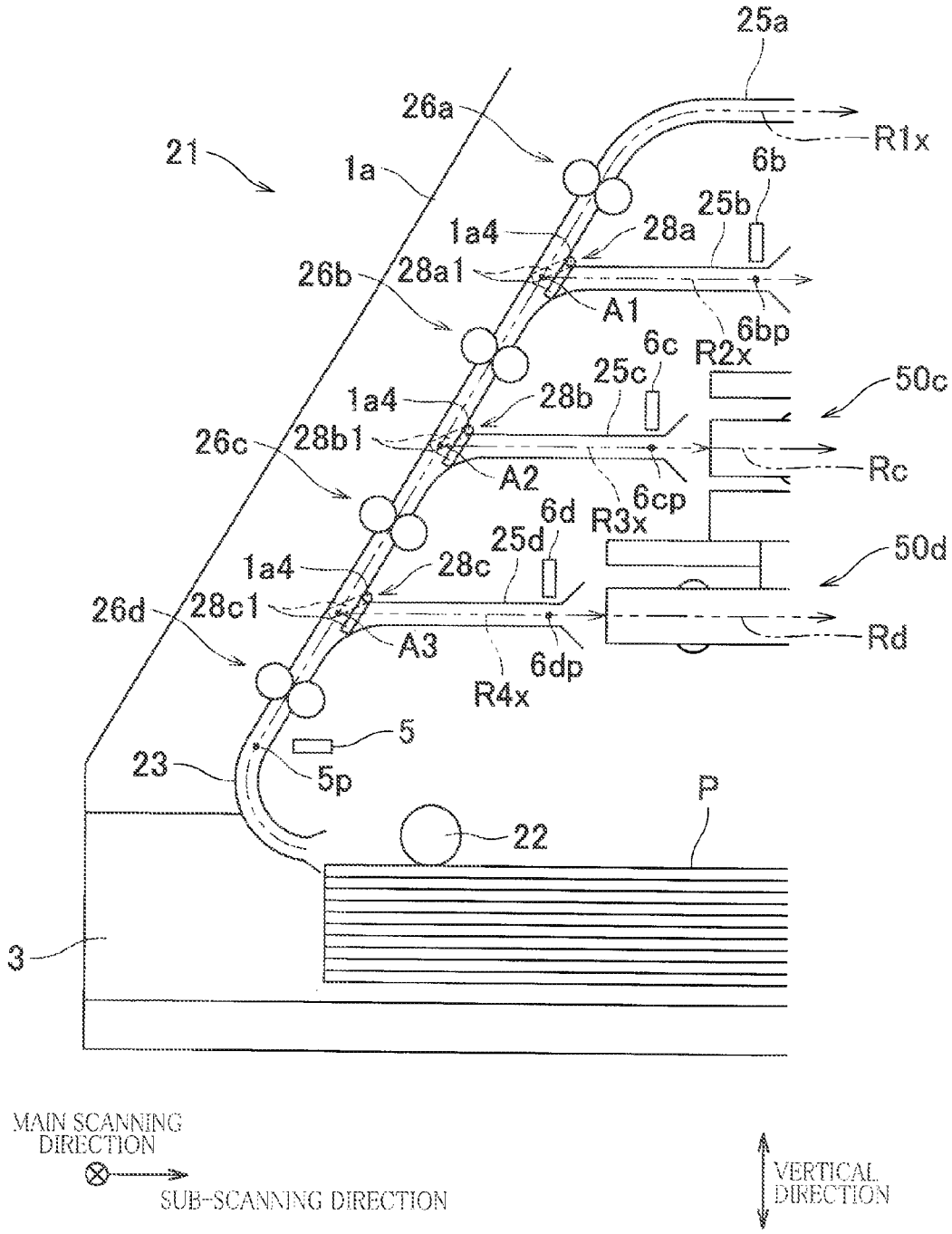
FIG. 2 is an enlarged view of the area II illustrated in FIG. 1.
Figure 6:
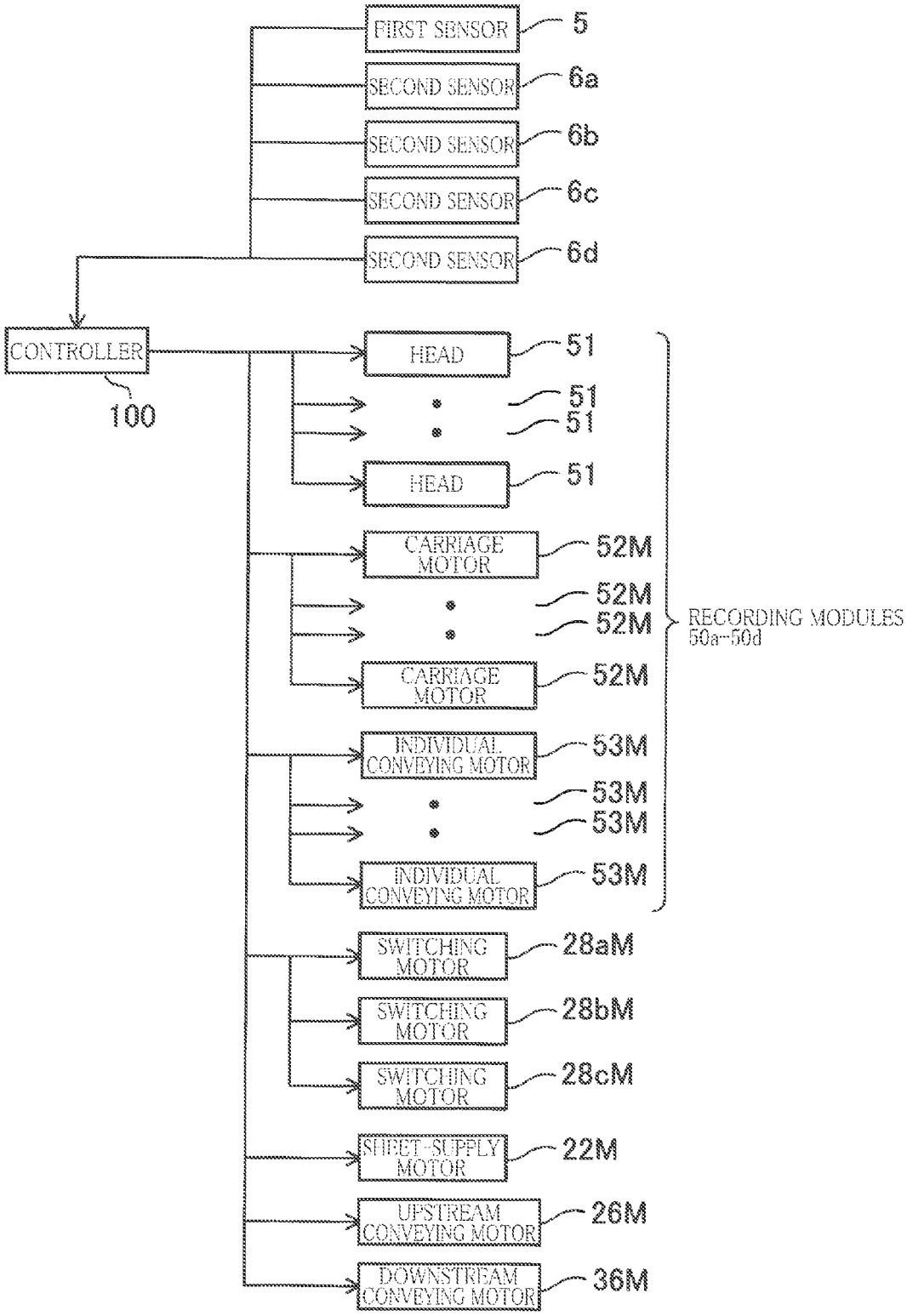
FIG. 6 is a block diagram illustrating an electric configuration of the printer illustrated in FIG. 1.

The switchers 28*a*-28*c* respectively include pivot members 28*a*1-28*c*1 (see FIG. 2) and switching motors 28*a*M-28*c*M (see FIG. 6). Each of the pivot members 28*a*1-28*c*1 is pivotable about a corresponding one of pins 1*a*4 provided in the housing 1*a*. The controller 100 drives each of the switching motors 28*a*M-28*c*M to switch a position of a corresponding one of the pivot members 28*a*1-28*c*1 between a first position indicated by solid lines in FIG. 2 and a second position indicated by broken lines in FIG. 2. At the first position, a distal end of each of the pivot members 28*a*1-28*c*1 is held in contact with the corresponding one of the guide 25*b*, 25*c*, 25*d*. At the second position, the distal end of each of the pivot members 28*a*1-28*c*1 is held in contact with the guide 23.

When the pivot member 28*a*1 is located at the first position, the path R1x is opened, and the path R2x is closed at the branch position A1. Accordingly, the sheet P having been conveyed from the sheet storage 3 to the branch portion A1 is conveyed to the module path Ra along the path R1x. When the pivot member 28*a*1 is located at the second position, the path R1x is closed, and the path R2x is opened at the branch position A1. Accordingly, the sheet P having been conveyed from the sheet storage 3 to the branch portion A1 is conveyed to the module path Rb along the path R2x.

When the pivot member 28*b*1 is located at the first position, the paths R1x, R2x are opened, and the path R3x is closed at the branch position A2. Accordingly, the sheet P having been conveyed from the sheet storage 3 to the branch portion A2 is conveyed to the branch position A1 along the shared portion of the paths R1x, R2x. When the pivot member 28*b*1 is located at the second position, the paths R1x, R2x are closed, and the path R3x is opened at the branch position A2. Accordingly, the sheet P having been conveyed from the sheet storage 3 to the branch portion A2 is conveyed to the module path Rc along the path R3x.

When the pivot member 28*c*1 is located at the first position, the paths R1x-R3x are opened, and the path R4x is closed at the branch position A3. Accordingly, the sheet P having been conveyed from the sheet storage 3 to the branch portion A3 is conveyed to the branch position A2 along the shared portion of the paths R1x-R3x. When the pivot member 28*c*1 is located at the second position, the paths R1x-R3x are closed, and the path R4x is opened at the branch position A3. Accordingly, the sheet P having been conveyed from the sheet storage 3 to the branch portion A3 is conveyed to the module path Rd along the path R4x.

A first sensor 5 is disposed between the sheet-supply roller 22 and the roller pair 26*d* at a position opposite the shared portion of the paths R1x-R4x. Second sensors 6*a*-6*d* are disposed opposite the respective downstream end portions of the paths R1x-R4x.

Each of the first sensor 5 and the second sensors 6*a*-6*d* is configured to output a signal indicating the presence or absence of the sheet P at a corresponding one of a first sensing position 5*p* and second sensing positions 6*ap*-6*dp*. Each of the first sensor 5 and the second sensors 6*a*-6*d* outputs an ON signal when there is a sheet P at the corresponding position, and outputs an OFF signal when there is no sheet P at the corresponding position. The first sensing position 5*p* is determined at a position near the shared portion of the paths R1x-R4x between the sheet-supply roller 22 and the roller pair 26*d*. Each of the second sensing positions 6*ap*-6*dp* is determined at a position near a corresponding one of the respective downstream end portions of the paths R1x-R4x. In other words, the second sensing positions 6*ap*-6*dp* are respectively determined at a position on the path R1x which is located downstream of the branch position A1, a position on the path R2x which is located downstream of the branch position A1, a position on the path R3x which is located downstream of the branch position A2, and a position on the path R4x which is located downstream of the branch position A3.

Each of the sensors 5, 6*a*-6*d* includes an ON counter and an OFF counter. When an ON signal is output, the ON counter produces a counter pulse which is proportional to an amount of rotation of the upstream conveying motor 26M and starts counting the number of pulses, and when another ON signal is thereafter output, the ON counter resets the count. When an OFF signal is output, the OFF counter produces a counter pulse which is proportional to an amount of rotation of the upstream conveying motor 26M and starts counting the number of pulses, and when another OFF signal is thereafter output, the OFF counter resets the count. Count data created by the ON counter represents an amount of conveyance of the sheet P from the timing when the leading edge of the sheet P has reached a sensing position of a corresponding one of the sensors 5, 6*a*-6*d*. Count data created by the OFF counter represents an amount of conveyance of the sheet P from the timing when the trailing edge of the sheet P has reached the sensing position of the corresponding one of the sensors 5, 6*a*-6*d*.

In the present embodiment, the recording module 50*d* corresponds to a first recording module, the recording module 50*a* to a second recording module, the path R4x to a first path, the path R1x to a second path, the branch position A3 to a branch position, the switcher 28*c* to a switcher, and the sheet-supply roller 22 and the roller pair 26*d* to a shared conveyor. The path R1x includes, at its upstream portion, a shared portion shared with the path R4x (which is a portion extending from the sheet storage 3 to the branch position A3), and the path R1x is branched off from the path R4x at the branch position A3 located at an end portion of the shared portion.

The paths R1y-R4y extend from the respective downstream end portions of the module paths Ra-Rd to the sheet receiver 4. The paths R1y, R2y extend from the respective downstream end portions of the module paths Ra, Rb, then merge with each other at a joining position B1, and extend from the joining position B1 to the sheet receiver 4 by the same route. The paths R2y, R3y extend from the respective downstream end portions of the module paths Rb, Rc, then merge with each other at a joining position B2, and extend from the joining position B2 to the sheet receiver 4 by the same route. The paths R3y, R4y extend from the respective downstream end portions of the module paths Rc, Rd, then merge with each other at a joining position B3, and extend from the joining position B3 to the sheet receiver 4 by the same route.

The downstream unit 31 includes the roller pairs 36*a*-36*d*, a roller pair 36*e*, and guides 33, 35*a*-35*d*.

Each of the roller pairs 36*a*-36*e* has two rollers contacting each other and conveys the sheet P, with the two rollers nipping the sheet P therebetween. One of the two rollers of each of the roller pairs 36*a*-36*e* is a drive roller which is rotated by a downstream conveying motor 36M (see FIG. 6) driven by the controller 100. The other of the two rollers of each of the roller pairs 36*a*-36*e* is a driven roller which is rotated, in a direction reverse to a direction of the rotation of the drive roller, by the rotation of the drive roller while contacting the drive roller. As a result, the sheet P conveyed from any of the module paths Ra-Rd is conveyed to the sheet receiver 4. The roller pairs 36*a*-36*e* are driven in synchronization with each other by the downstream conveying motor 36M.

Each of the guides 33, 35*a*-35*d* defines a corresponding one or ones of the paths R1y-R4y and includes a pair of plates arranged spaced apart from each other. The guides 35*a*-35*d* extend in the horizontal direction and define the respective upstream portions of the paths R1y-R4y. The guide 33 extends obliquely with respect to the vertical direction and defines the downstream portions of the respective paths R1y-R4y. The guide 35*d* is connected to the other end portion of the guide 33 from the sheet receiver 4, and the guides 35*a*-35*c* are connected to the guide 33 other than its end portions.

Each of the sheet storage 3 and the sheet receiver 4 is mountable on and removable from the housing 1*a* in a sub-scanning direction. The sheet storage 3 is a tray opening upward and can store a plurality of sheets P. The sheet receiver 4 is a tray opening upward and can receive or support a plurality of sheets P. Each of the sheet storage 3 and the sheet receiver 4 can store or receive the sheets P of various sizes including the postcard size, the A6 size, the A4 size, the letter size, and the A3 size.

In the present embodiment, the sheet P of the A3 size corresponds to the longest recording medium. Also, the length of the sheet P (i.e., the length of the sheet P in a direction D along the module paths Ra-Rd) is one example of the length of the recording medium.

The sub-scanning direction is parallel with the horizontal plane and parallel with the respective downstream portions of the paths R1x-R4x, the module paths Ra-Rd, and the respective upstream portions of the paths R1y-R4y. A main scanning direction is a direction parallel with the horizontal plane and perpendicular to the sub-scanning direction. The vertical direction is perpendicular to the sub-scanning direction and the main scanning direction.

The controller 100 includes a central processing unit (CPU) as a computing device, a read only memory (ROM), a random access memory (RAM) including a non-transitory RAM, an application specific integrated circuit (ASIC), an interface (I/F), and an input/output port (I/O). The ROM stores programs to be executed by the CPU, various kinds of fixed data, and other similar data. The RAM temporarily stores data necessary for execution of the programs, such as image data, count data of various counters, and various control flags. The ASIC executes rewriting and sorting of image data and other processings such as a signal processing and an image processing. The interface transmits and receives data to and from an external device such as a PC connected to the printer 1. The input/output port inputs and outputs signals produced by various sensors.

Figure 3:
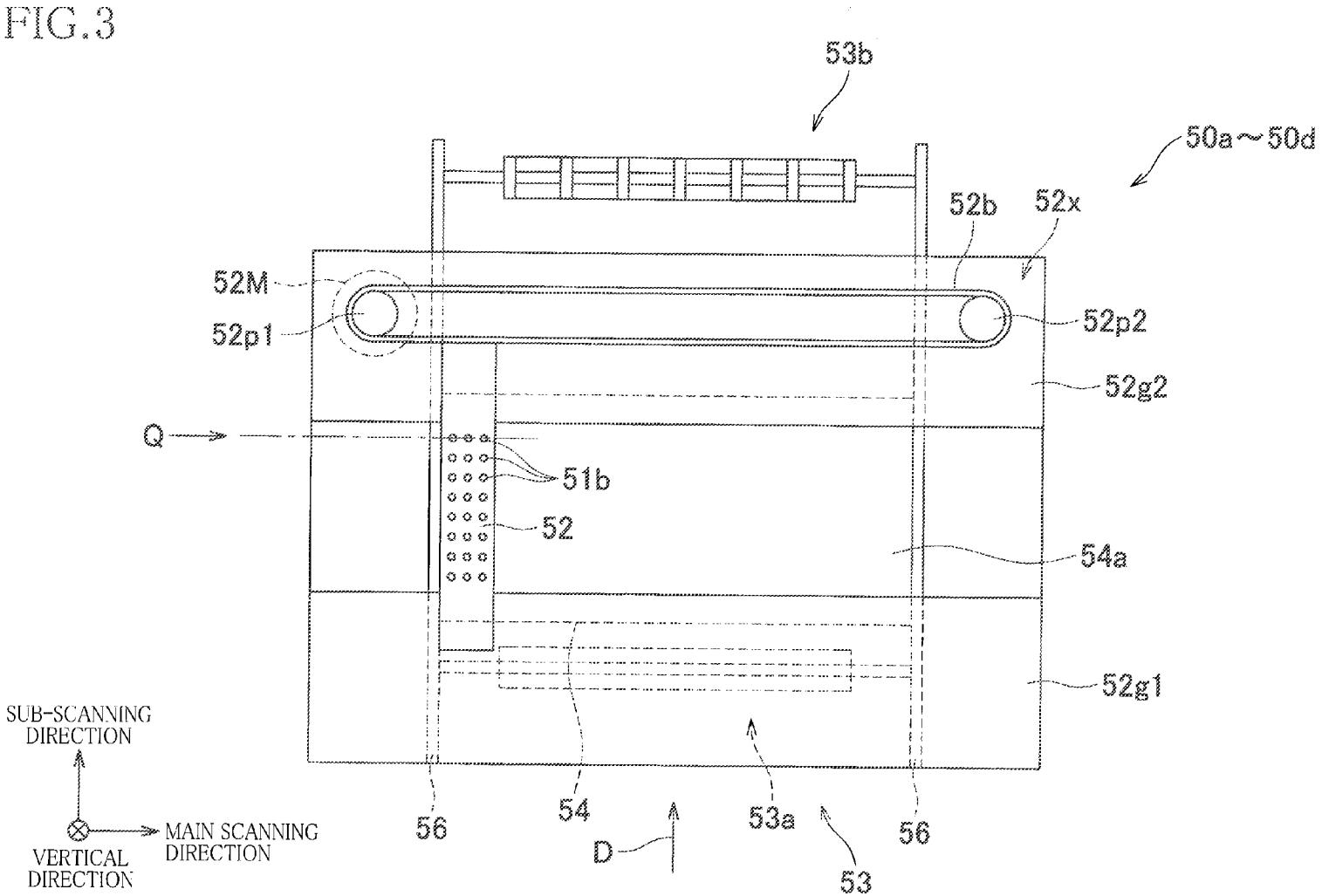
FIG. 3 is a plan view of a recording module of the printer illustrated in FIG. 1.
Figure 4:
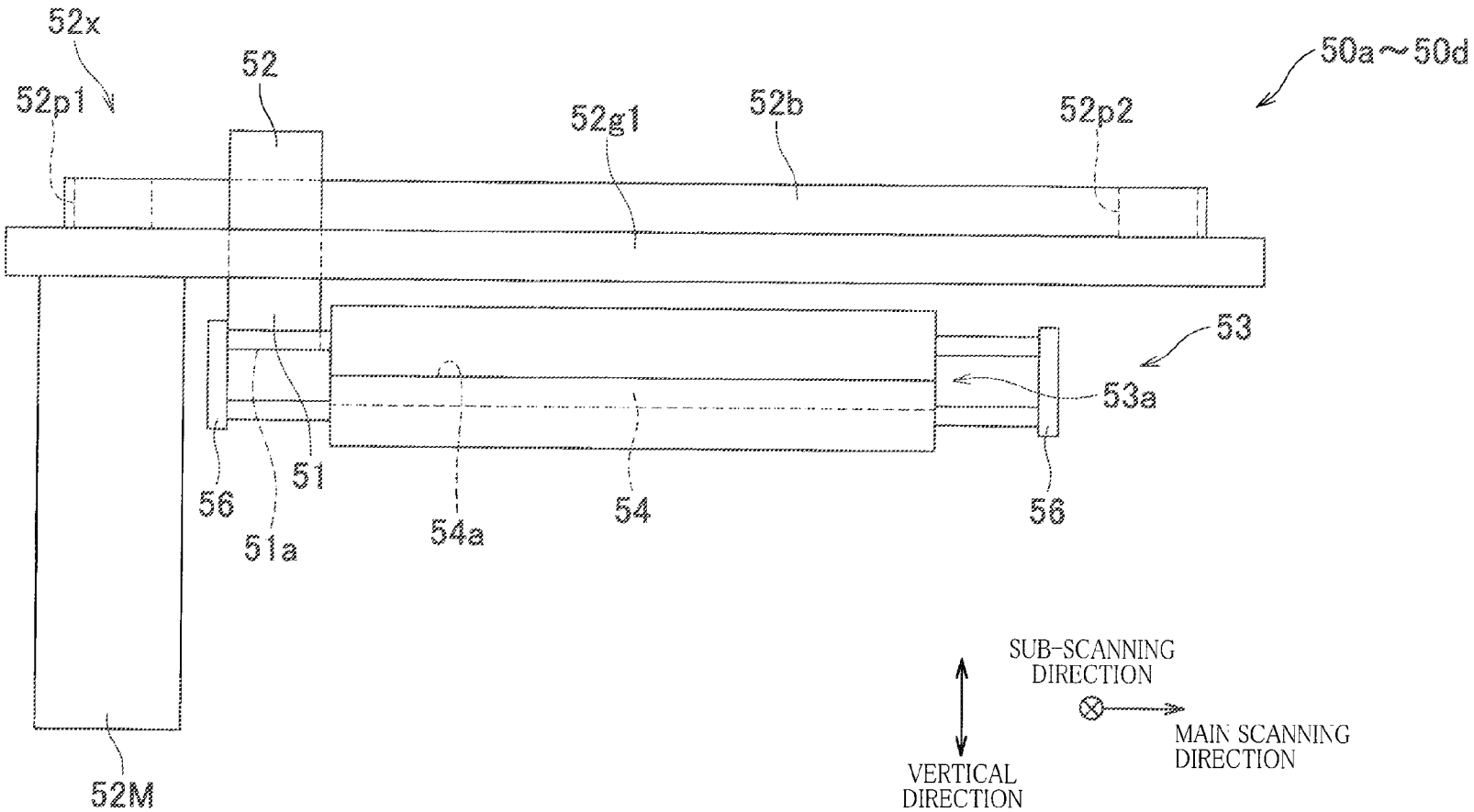
FIG. 4 is a front elevational view of the recording module of the printer illustrated in FIG. 1.
Figure 5:
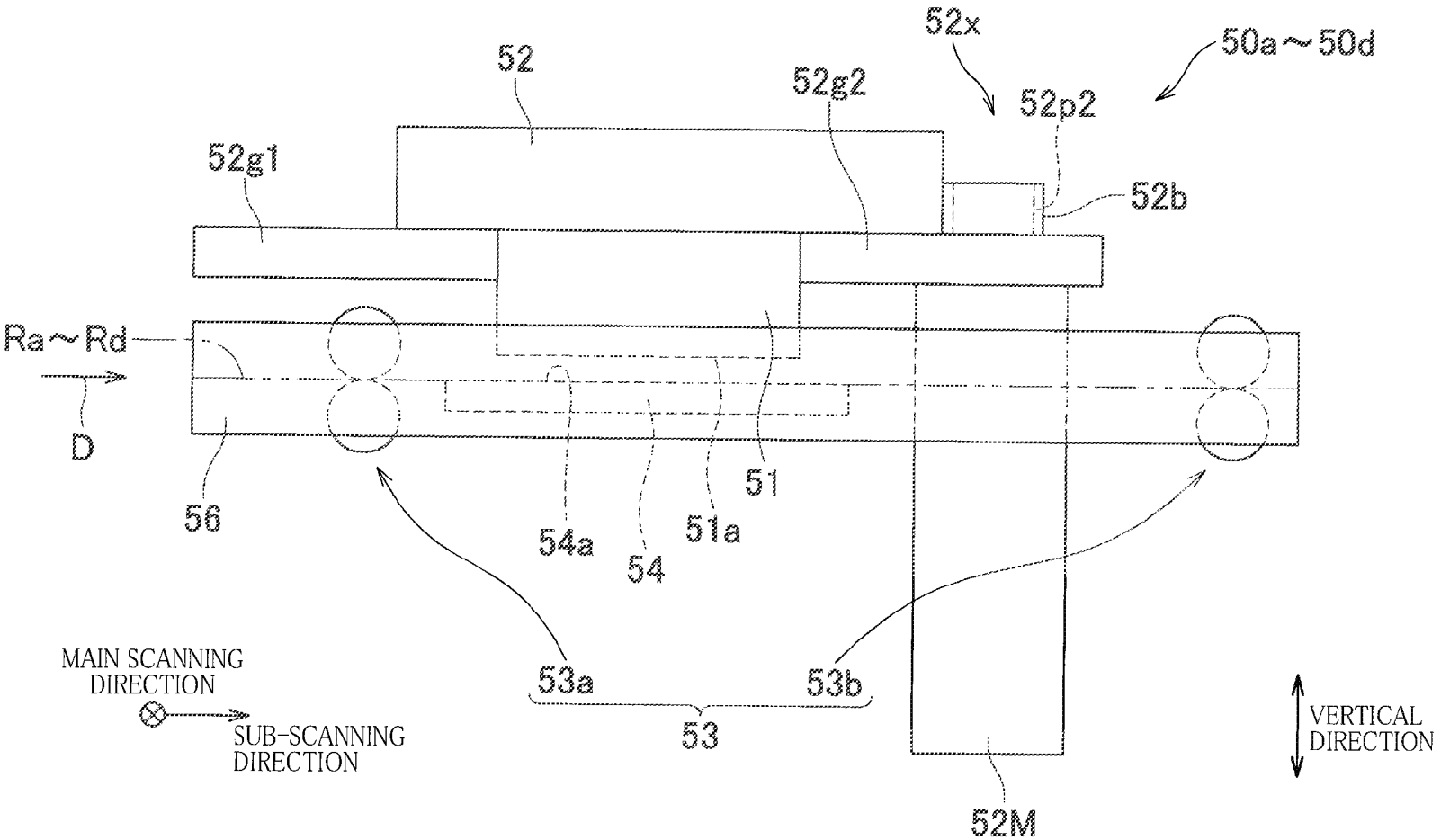
FIG. 5 is a side view of the recording module of the printer illustrated in FIG. 1.

There will be next explained the recording modules 50*a*-50*d* with reference to FIGS. 3-5.

Each of the recording modules 50*a*-50*d* includes the head 51, a carriage 52, and an individual conveyor 53.

The head 51 is a serial head having a generally rectangular parallelepiped shape and supported by the housing 1*a* via the carriage 52. An upper surface of the head 51 is fixed to the carriage 52. A lower surface of the head 51 is an ejection surface 51*a* having the plurality of ejection openings 51*b* opening therein.

The carriage 52 is reciprocable in the main scanning direction by a carriage moving device 52*x*. The carriage 52 supports the head 51 and reciprocates the head 51 in the main scanning direction. The carriage moving device 52*x* includes guides 52*g*1, 52*g*2, pulleys 52*p*1, 52*p*2, a belt 52*b*, and a carriage motor 52M. Each of the guides 52*g*, 52*g*2 has a rectangular shape when viewed in the vertical direction, and the guides 52*g*1, 52*g*2 are spaced apart from each other in the sub-scanning direction.

An upper portion of the head 51 is interposed between the guides 52*g*1, 52*g*2 which respectively support opposite ends of the carriage 52 in the sub-scanning direction such that the carriage 52 is slidable in the main scanning direction. The pulleys 52*p*1, 52*p*2 are rotatably supported by opposite end portions of the guide 52*g*2 in the main scanning direction. The pulleys 52*p*1, 52*p*2 have the same diameter and are arranged at the same position in the sub-scanning direction. The belt 52*b* is an endless belt looped over the pulleys 52*p*1, 52*p*2 and travels by the rotation of the pulleys 52*p*1, 52*p*2. The carriage 52 is fixed to the belt 52*b*. The carriage motor 52M has a circular cylindrical shape elongated in the vertical direction and is fixed to a lower surface of the guide 52*g*2. A rotation shaft of the carriage motor 52M is mounted on the pulley 52*p*1 so as to extend in the vertical direction.

The pulley 52*p*1 is a drive pulley which is rotated forwardly and reversely by the carriage motor 52M driven by the controller 100. The rotation of the pulley 52*p*1 rotates the belt 52*b*. The pulley 52*p*2 is a driven pulley which is rotated by the rotation of the belt 52*b*. With the operations of the components and devices of the carriage moving device 52*x*, the carriage 52 supporting the head 51 is reciprocated in the main scanning direction. During this reciprocation, the controller 100 controls the head 51 to eject the ink from the ejection openings 51*b* at desired timings to record an image on the sheet P.

Each of the individual conveyors 53 is configured to intermittently convey the sheet P along the corresponding one of the module paths Ra-Rd in the direction D and includes roller pairs 53*a*, 53*b* and an individual conveying motor 53M (see FIG. 6). The roller pairs 53*a*, 53*b* are rotated by the individual conveying motor 53M driven by the controller 100. This rotation conveys the sheet P in the direction D. The direction D is a direction parallel with the sub-scanning direction and directed from an upstream side to a downstream side of each of the module paths Ra-Rd. The roller pairs 53*a*, 53*b* extend in the main scanning direction and interpose the head 51 in the sub-scanning direction. That is, in each of the module paths Ra-Rd, the roller pair 53*a* is disposed upstream of the head 51, and the roller pair 53*b* is disposed downstream of the head 51.

In the present embodiment, the sub-scanning direction is one example of a first direction, and the direction D is one example of a second direction.

A platen 54 is disposed between the roller pairs 53*a*, 53*b* at a position opposite the ejection surface 51*a*. The platen 54 has a flat upper surface 54*a* which can support a lower surface of the sheet P. A space appropriate for recording is formed between the ejection surface 51*a* and the upper surface 54*a*.

The roller pairs 53*a*, 53*b* and the platen 54 are supported by a pair of flanges 56. The pair of flanges 56 extending in the sub-scanning direction are spaced apart from each other in the main scanning direction.

An upper one of two rollers of the roller pair 53*b* is a spur roller provided with a plurality of spurs, in order not to deteriorate the image recorded on the sheet P when the roller pair 53*b* nips the sheet P.

The controller 100 controls each of the recording modules 50*a*-50*d* to perform (i) an intermittently conveying operation in which the sheet P is intermittently conveyed in the direction D by the corresponding individual conveyor 53 and (ii) a reciprocating operation in which, during a conveyance stopped period in which the sheet P is stopped in the intermittently conveying operation, the ink is ejected from the ejection openings 51*b* while the carriage 52 is reciprocated in the main scanning direction.

The roller pair 53*b* is a one-way roller. That is, rotational power of the roller pair 53*a* is transmitted to the roller pair 53*b*, but rotational power of the roller pair 53*b* is not transmitted to the roller pair 53*a*. Accordingly, while the image-recorded sheet P is successively conveyed toward the sheet receiver 4 by successive drivings of the roller pair 53*b*, the next sheet P can be intermittently conveyed in a corresponding one of the module paths Ra-Rd by intermittent drivings of the roller pair 53*a*. This configuration can improve a throughput. In a configuration in which the roller pair 53*b* is not the one-way roller, but the roller pairs 53*a*, 53*b* are driven in complete synchronization with each other, unlike the present embodiment, when a leading edge of the next sheet P reaches the roller pair 53*a* in the corresponding one of the module paths Ra-Rd before a trailing edge of the sheet P reaches a downstream side of the roller pair 53*b*, the roller pairs 53*a*, 53*b* are both driven intermittently, so that the image-recorded sheet P cannot be successively conveyed toward the sheet receiver 4 by the roller pair 53*a*.

There will be next explained processings to be executed by the controller 100 with reference to FIGS. 7-10.

When a recording command is received from the external device, the controller 100 initially determines which recording module the sheet P is to be supplied to (that is, the controller determines a destination of supply of the sheet P) by referring to information contained in the recording command which represents the size and the number of sheets P and to a table representing correspondence between a destination of the supply and the size and the number of sheets P. The table is stored in the ROM, for example.

The recording modules 50*a*-50*d* are used in order from the top, i.e., the upper recording module in the case where the sheet P is of the A4 size or the letter size. Specifically, in a case where recording is successively performed on a plurality of sheets P of the A4 size or the letter size, the first sheet P is supplied to the recording module 50*a*, the second sheet P to the recording module 50*b*, the third sheet P to the recording module 50*c*, and the fourth sheet P to the recording module 50*d*. That is, in the case where the sheet P is of the A4 size or the letter size, the 4m+1th sheet P (n=4m+1 (m is an integer greater than or equal to zero)) is supplied to the uppermost recording module 50*a*, the 4m+2th sheet P (n=4m+2) to the second recording module 50*b* from the top, the 4m+3th sheet P (n=4m+3) to the third recording module 50*c* from the top, and the 4m+4th sheet P (n=4m+4) to the fourth recording module 50*d* from the top (see FIG. 11).

Figure 11:
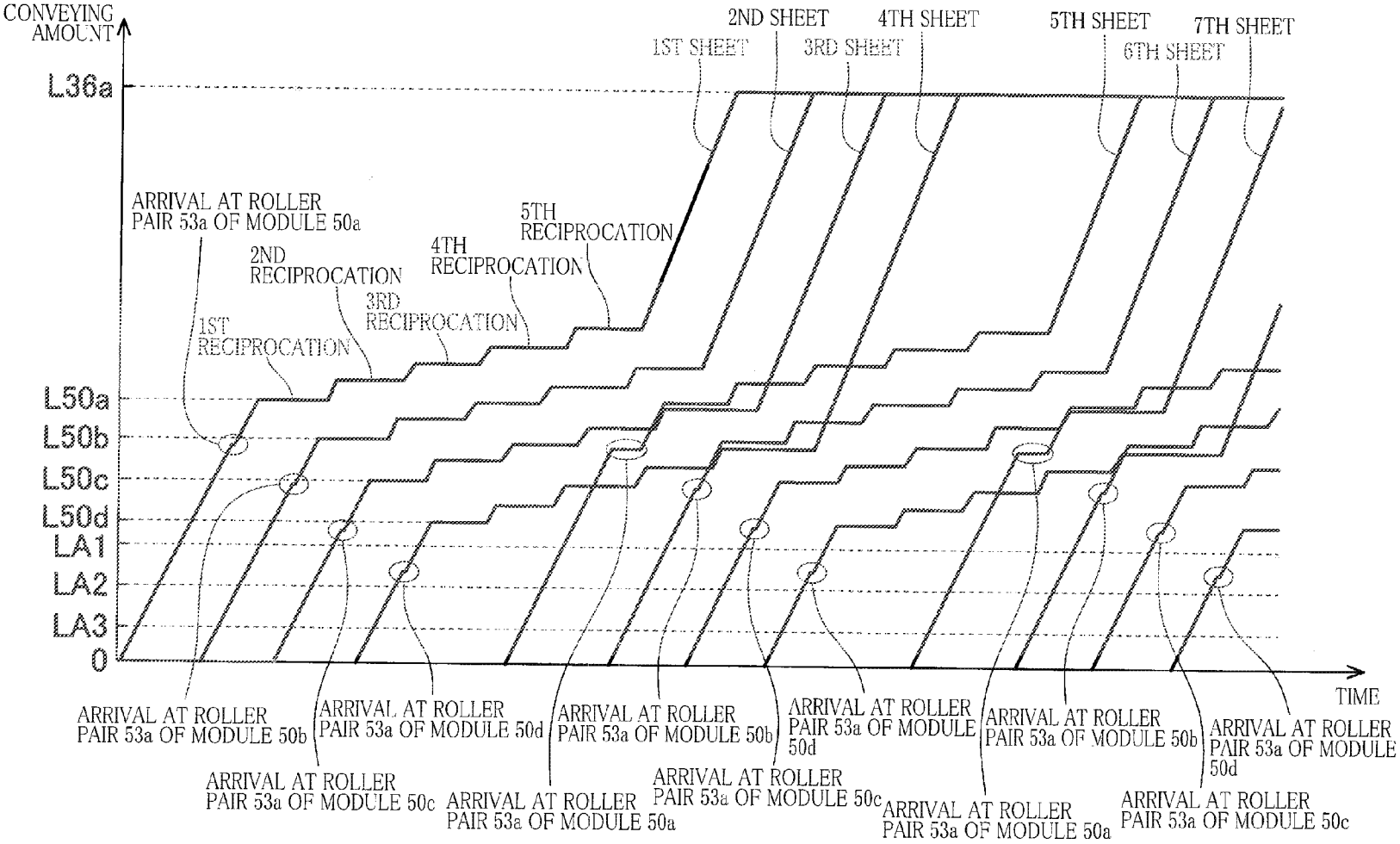
FIG. 11 is a diagram illustrating conveyance of sheets in a case where recording is successively performed on a plurality of sheets of the A4 size or the letter size.

FIG. 11 illustrates a situation of conveyance of sheets P in a case where recording is successively performed on seven sheets P of the A4 size or the letter size, with the horizontal axis representing time, and the vertical axis representing an amount of conveyance of the sheet P. The starting point (i.e., the origin point 0) of the vertical axis is the sheet storage 3. The characters "L36a" represent a distance from the sheet storage 3 to the roller pair 36*a* along the corresponding path. Each of the characters "L50a"–"L50d" represents a distance from the sheet storage 3 to a recording starting position in a corresponding one of the recording modules 50*a*-50*d* along the corresponding path. Each of the characters "LA1"–"LA3" represents a distance from the sheet storage 3 to a corresponding one of the branch positions A1-A3 along the corresponding path.

In the case where the sheet P is of the A3 size, the uppermost recording module 50*a* and the third recording module 50*c* from the top are repeatedly used in this order. Specifically, in a case where recording is successively performed on a plurality of sheets P of the A3 size, the first sheet P is supplied to the recording module 50*a*, the second sheet P to the recording module 50*c*, the third sheet P to the recording module 50*a*, and the fourth sheet P to the recording module 50*c*. That is, in the case where the sheet P is of the A3 size, the 4m+1th sheet P (n=4m+1) or the 4m+3th sheet P (n=4m+3) is supplied to the uppermost recording module 50*a*, and the 4m+2th sheet P (n=4m+2) or the 4m+4th sheet P (n=4m+4) is supplied to the third recording module 50*c* from the top.

After determination of the destination of supply of the sheet P, the controller 100 executes a recording module control routine (see FIGS. 7 and 8), a switcher control routine (see FIG. 9), an upstream roller control routine (see FIG. 10), and a downstream roller control routine, not shown, in parallel. The recording module control routine includes: a control to be executed for upstream rollers (including the sheet-supply roller 22 and the roller pairs 26*a*-26*d*), the switchers 28*a*-28*c*, and so on when the sheet P is conveyed from the sheet storage 3 toward a corresponding one of the recording modules 50*a*-50*d* as the destination of supply of the sheet P; and a control for the intermittently conveying operation and the reciprocating operation performed by the corresponding one of the recording modules 50*a*-50*d*. This recording module control routine is executed for the recording modules 50*a*-50*d* in parallel. The switcher control routine includes a control for switch of the position of each of the pivot members 28*a*1-28*c*1 of the switchers 28*a*-28*c* and is executed for the switchers 28*a*-28*c* in parallel. The upstream roller control routine includes a control for driving and stopping the upstream rollers. The downstream roller control routine includes a control for driving the downstream rollers (including the roller pairs 36*a*-36*e*). In the downstream roller control routine, the controller 100 controls the downstream conveying motor 36M to drive the downstream rollers to convey the sheet P along a corresponding one of the paths R1y-R4y onto the sheet receiver 4.

Figure 7:
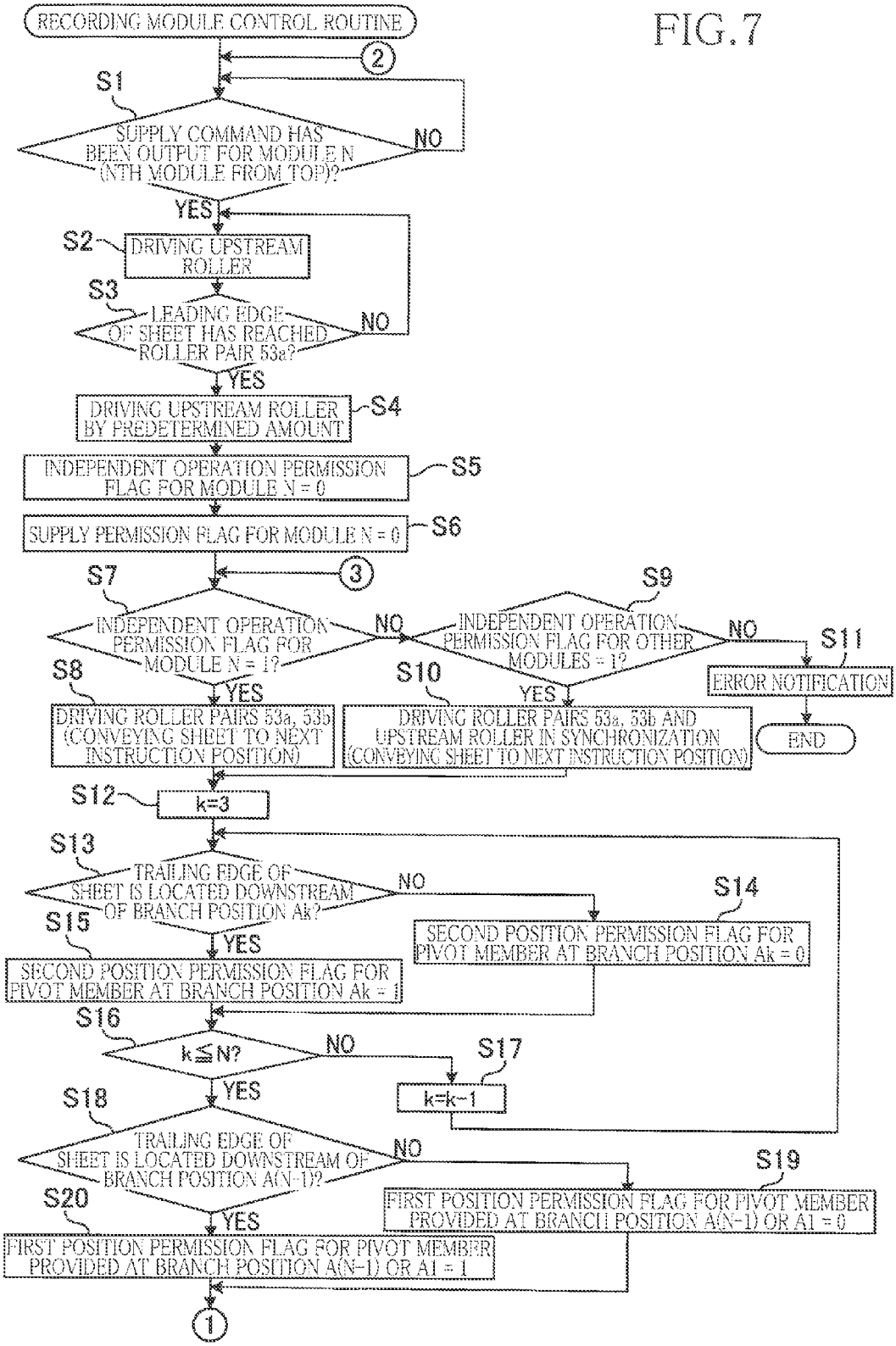
FIG. 7 is a flow chart illustrating a first portion of a recording module control routine to be executed by a controller of the printer illustrated in FIG. 1.

In the recording module control routine, as illustrated in FIG. 7, this flow begins with S1 at which the controller 100 determines whether a supply command has been output for the module N or not. The module N is an Nth recording module from the top among the recording modules 50*a*-50*d*. In the present embodiment, the recording module control routine is executed for the case where the variable N is 1, 2, 3, or 4.

When the supply command is not output for the module N (S1: NO), the controller 100 repeats the processing at S1. When the supply command is output for the module N (S1: YES), the controller 100 at S2 controls the sheet-supply motor 22M and the upstream conveying motor 26M to drive the upstream rollers to supply a sheet P to the module N. As a result, the sheet P stored in the sheet storage 3 is conveyed by the sheet-supply roller 22 and a corresponding one of the roller pairs 26*a*-26*d* along a corresponding one of the paths R1x-R4x to the module path (i.e., a corresponding one of the module paths Ra-Rd) of the module N.

After S2, the controller 100 at S3 determines, based on the signal output from the first sensor 5, whether a leading edge of the sheet P has reached the roller pair 53*a* of the module N or not. That is, the controller determines whether or not an amount of conveyance of the sheet P from the point in time when the leading edge of the sheet P has reached the first sensing position 5*p* has reached a distance or amount Lx between the first sensing position 5*p* and the roller pair 53*a* along the corresponding path. The amount of conveyance of the sheet P from the point in time when the leading edge of the sheet P has reached the first sensing position 5*p* is calculated based on the count data created by the ON counter of the first sensor 5. In FIG. 1, the distance Lx represents a distance along the path R1x between the first sensing position 5*p* and the roller pair 53*a* for the recording module 50*a*.

When the leading edge of the sheet P has not reached the roller pair 53*a* of the module N (S3: NO), this flow returns to S2. When the leading edge of the sheet P has reached the roller pair 53*a* of the module N (S3: YES), the controller 100 at S4 controls the sheet-supply motor 22M and the upstream conveying motor 26M to drive the upstream rollers by a predetermined amount to cause a particular bend on the sheet P.

After S4, the controller 100 at S5 sets an independent operation permission flag for the module N to 0. The controller 100 at S6 sets a supply permission flag for the module N to 0. In the case where the independent operation permission flag for the module N is 0, the roller pair 53*a* of the module N and the upstream rollers are nipping the same sheet P at the same time and accordingly need to be driven in synchronization with each other. In the case where the independent operation permission flag for the module N is 1, the roller pair 53*a* of the module N and the upstream rollers are not nipping the same sheet P at the same time and accordingly can be driven independently of each other. In the case where the supply permission flag for the module N is 0, the roller pair 53*a* of the module N is nipping the sheet P, and accordingly the controller 100 cannot execute a processing for conveying another sheet P to the roller pair 53*a*. In the case where the supply permission flag for the module N is 1, the roller pair 53*a* of the module N is not nipping the sheet P, and accordingly the controller 100 can execute the processing for conveying another sheet P to the roller pair 53*a*.

After S6, the controller 100 at S7 determines whether the independent operation permission flag for the module N is 1 or not. When the independent operation permission flag for the module N is 1 (S7: YES), the controller 100 at S8 controls the individual conveying motor 53M for the module N to drive the roller pairs 53*a*, 53*b* for the module N to convey the sheet P to the next instruction position. The next instruction position at the processing S8 executed for the first time is a position at which a leading edge portion of an image recording area on the sheet P is opposite the head 51, and the next instruction position at the processing S8 executed for the second or subsequent time is a position at which the sheet P has been moved forward by an amount corresponding to a single operation of the intermittently conveying operation.

When the independent operation permission flag for the module N is not 1 (S7: NO), the controller 100 at S9 determines whether the independent operation permission flag is 1 or not for each of all the recording modules other than the module N. When the independent operation permission flag is 1 for each of all the recording modules other than the module N (S9: YES), the controller 100 at S10 controls the individual conveying motor 53M for the module N and the upstream conveying motor 26M to drive the roller pairs 53*a*, 53*b* for the module N and the upstream rollers in synchronization with each other to convey the sheet P to the next instruction position.

When the independent operation permission flag is not 1 for any of the recording modules other than the module N (S9: NO), the controller 100 at S11, for example, controls a voice output device (e.g., a speaker) and an image output device (e.g., a display) provided on the printer 1, to output a voice and an image for error notification. After S11, the controller 100 finishes all the controls including this recording module control routine and stops the operation of the printer 1.

After S8 or S10, the controller 100 at S12 sets a variable k to 3 (k=3). After S12, the controller 100 at S13 determines, based on the signal output from the first sensor 5, whether a trailing edge of the sheet P is located downstream of a branch position Ak on the corresponding path or not. That is, the controller 100 determines whether an amount of conveyance of the sheet P from the point in time when the trailing edge of the sheet P has reached the first sensing position 5*p* has exceeded a distance or amount Ly between the first sensing position 5*p* and the branch position Ak along the corresponding path or not. The amount of conveyance of the sheet P from the point in time when the trailing edge of the sheet P has reached the first sensing position 5*p* is calculated based on the count data created by the OFF counter of the first sensor 5. In FIG. 1, the distance Ly is a distance between the first sensing position 5*p* and the branch position A1 along the path R1 x.

When the trailing edge of the sheet P is located downstream of the branch position Ak on the corresponding path (S13: NO), the controller 100 at S14 sets a second position permission flag for one of the pivot members 28*a*1-28*c*1 which is provided at the branch position Ak to 0. When the trailing edge of the sheet P is located downstream of the branch position Ak on the corresponding path (S13: YES), the controller 100 at S15 sets the second position permission flag for one of the pivot members 28*a*1-28*c*1 which is provided at the branch position Ak to 1. In the case where the second position permission flag for one of the pivot members 28*a*1-28*c*1 which is provided at the branch position Ak is 0, the sheet P is present between the inner wall of the guide 23 and a distal end of the one of the pivot members 28*a*1-28*c*1, and when the one of the pivot members 28*a*1-28*c*1 which is provided at the branch position Ak is moved to the second position, the sheet P is nipped between the inner wall of the guide 23 and the distal end of the one of the pivot members 28*a*1-28*c*1, and accordingly the one of the pivot members 28*a*1-28*c*1 cannot be moved to the second position. In the case where the second position permission flag for one of the pivot members 28*a*1-28*c*1 which is provided at the branch position Ak is 1, no sheet P is present between the inner wall of the guide 23 and the distal end of the one of the pivot members 28*a*1-28*c*1, and accordingly the one of the pivot members 28*a*1-28*c*1 can be moved to the second position.

After S14 or S15, the controller 100 at S16 determines whether or not the variable k is smaller than or equal to the variable N (k≤N). When the variable k is not smaller than or equal to the variable N (S16: NO), the controller 100 at S17 sets the variable k to k−1 (k=k−1), and this flow returns to S13. When the variable k is smaller than or equal to the variable N (S16: YES), as in the processing at S13, the controller 100 at S18 determines, based on the signal output from the first sensor 5, whether the trailing edge of the sheet P is located downstream of a branch position A(N−1) (noted that this branch position A(N−1) is the branch position A1 in the case where the variable N is 1 (N=1)) on the corresponding path or not.

When the trailing edge of the sheet P is not located downstream of the branch position A(N−1) on the corresponding path (S18: NO), the controller 100 at S19 sets a first position permission flag for one of the pivot members 28*a*1-28*c*1 which is provided at the branch position A(N−1), to 0. When the trailing edge of the sheet P is located downstream of the branch position Ak on the corresponding path (S13: YES), the controller 100 at S20 sets the first position permission flag for the one of the pivot members 28*a*1-28*c*1 which is provided at the branch position A(N−1), to 1.

Figure 8:
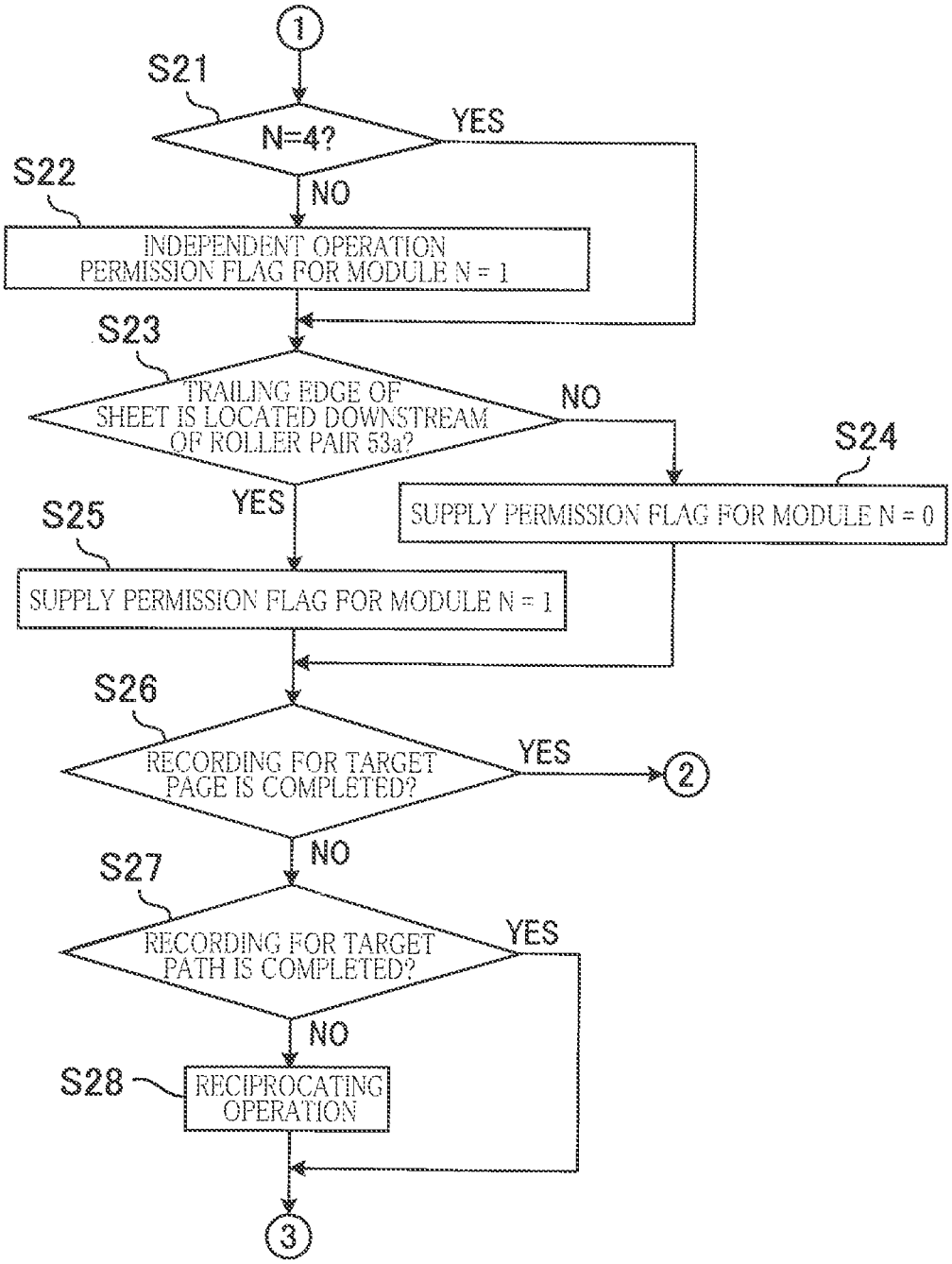
FIG. 8 is a flow chart illustrating a second portion of the recording module control routine to be executed by the controller of the printer illustrated in FIG. 1.

After S19 or S20, as illustrated in FIG. 8, the controller 100 at S21 determines the variable N is 4 (N=4) or not. When the variable N is 4 (S21: YES), this flow goes to S23. When the variable N is not 4 (S21: NO), the controller 100 at S22 sets the independent operation permission flag for the module N to 1. After S22, the controller 100 at S23 determines, based on the signal output from the first sensor 5, whether the trailing edge of the sheet P is located downstream of the roller pair 53*a* on the corresponding path or not. That is, the controller determines whether the amount of conveyance of the sheet P from the point in time when the trailing edge of the sheet P has reached the first sensing position 5*p* has exceeded the distance Lx or not.

When the trailing edge of the sheet P is not located downstream of the roller pair 53*a* on the corresponding path (S23: NO), the controller 100 at S24 sets the supply permission flag for the module N to 0. When the trailing edge of the sheet P is located downstream of the roller pair 53*a* on the corresponding path (S23: YES), the controller 100 at S25 sets the supply permission flag for the module N to 1.

After S24 or S25, the controller 100 at S26 refers to the image data contained in the recording command to determine whether recording for a target page is completed or not. That is, the controller determines whether or not recording is completed for a front surface of the sheet P which is a surface facing downward in the sheet storage 3 and facing the head 51 during recording. When the recording for the target page is completed (S26: YES), this flow returns to S1.

When the recording for the target page is not completed (S26: NO), the controller 100 at S27 refers to the image data contained in the recording command to determine whether recording for a target path (i.e., a path of the movement of the head 51 during a single reciprocating operation) is completed or not. That is, the controller 100 determines whether or not recording by an amount corresponding to a single reciprocating operation is completed for a portion of the sheet P which faces the head 51 at this point in time.

When the recording for the target path is completed (S27: YES), this flow returns to S7. When the recording for the target path is not completed (S27: NO), the controller 100 at S28 controls the head 51 and the carriage motor 52M for the module N to perform the reciprocating operation, and this flow returns to S7.

Figure 9:
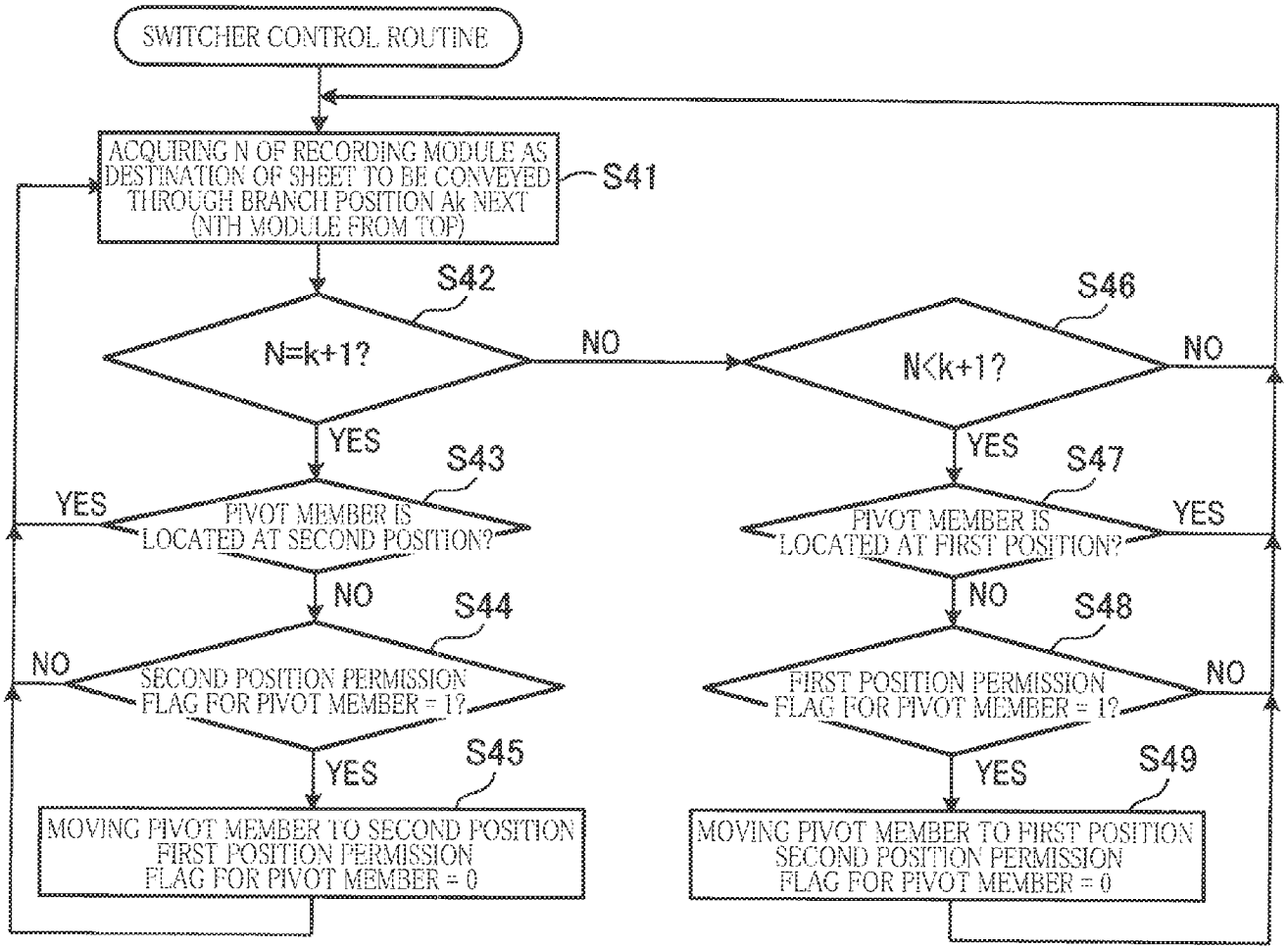
FIG. 9 is a flow chart illustrating a switcher control routine to be executed by the controller of the printer illustrated in FIG. 1.

In the switcher control routine, as illustrated in FIG. 9, this flow begins with S41 at which the controller 100 acquires the number N of the recording module as a destination of supply of the sheet P to be conveyed through the branch position Ak next. The branch position Ak is one of the branch positions A1-A3. In the present embodiment, the switcher control routine is executed in parallel for the cases where the variable k is 1, 2, and 3.

After S41, the controller 100 at S42 determines whether the variable N is equal to the variable k+1 (N=k+1) or not. When the variable N is equal to the variable k+1 (S42: YES), the controller 100 at S43 determines whether one of the pivot members 28*a*1-28*c*1 which is provided at the branch position Ak is located at the second position or not. When the one of the pivot members 28*a*1-28*c*1 which is provided at the branch position Ak is located at the second position (S43: YES), this flow returns to S41. When the one of the pivot members 28*a*1-28*c*1 which is provided at the branch position Ak is not located at the second position (S43: NO), the controller 100 at S44 determines whether the second position permission flag for the one of the pivot members 28*a*1-28*c*1 is 1 or not. When the second position permission flag for the one of the pivot members 28*a*1-28*c*1 which is provided at the branch position Ak is not 1 (S44: NO), this flow returns to S41. When the second position permission flag for the one of the pivot members 28*a*1-28*c*1 which is provided at the branch position Ak is 1 (S44: YES), the controller 100 at S45 controls a corresponding one of the switching motors 28*a*M-28*c*M to move the one of the pivot members 28*a*1-28*c*1 to the second position and sets the first position permission flag for the one of the pivot members 28*a*1-28*c*1 to 0. After S45, this flow returns to S41.

When the variable N is not equal to the variable k+1 (S42: NO), the controller 100 at S46 determines whether or not the variable N is smaller than the variable k+1 (N<k+1) or not. When the variable N is not smaller than the variable k+1 (S46: NO), this flow returns to S41. When the variable N is smaller than the variable k+1 (S46: YES), the controller 100 at S47 determines whether the one of the pivot members 28*a*1-28*c*1 which is provided at the branch position Ak is located at the first position or not. When the one of the pivot members 28*a*1-28*c*1 which is provided at the branch position Ak is located at the first position (S47: YES), this flow returns to S41. When the one of the pivot members 28*a*1-28*c*1 which is provided at the branch position Ak is not located at the first position (S47: NO), the controller 100 at S48 determines whether the first position permission flag for the one of the pivot members 28*a*1-28*c*1 is 1 or not. When the first position permission flag for the one of the pivot members 28*a*1-28*c*1 which is provided at the branch position Ak is not 1 (S48: NO), this flow returns to S41. When the first position permission flag for the one of the pivot members 28*a*1-28*c*1 which is provided at the branch position Ak is 1 (S48: YES), the controller 100 at S49 controls a corresponding one of the switching motors 28*a*M-28*c*M to move the one of the pivot members 28*a*1-28*c*1 which is provided at the branch position Ak to the first position and sets the second position permission flag for the one of the pivot members 28*a*1-28*c*11 to 0. After S49, this flow returns to S41.

Figure 10:
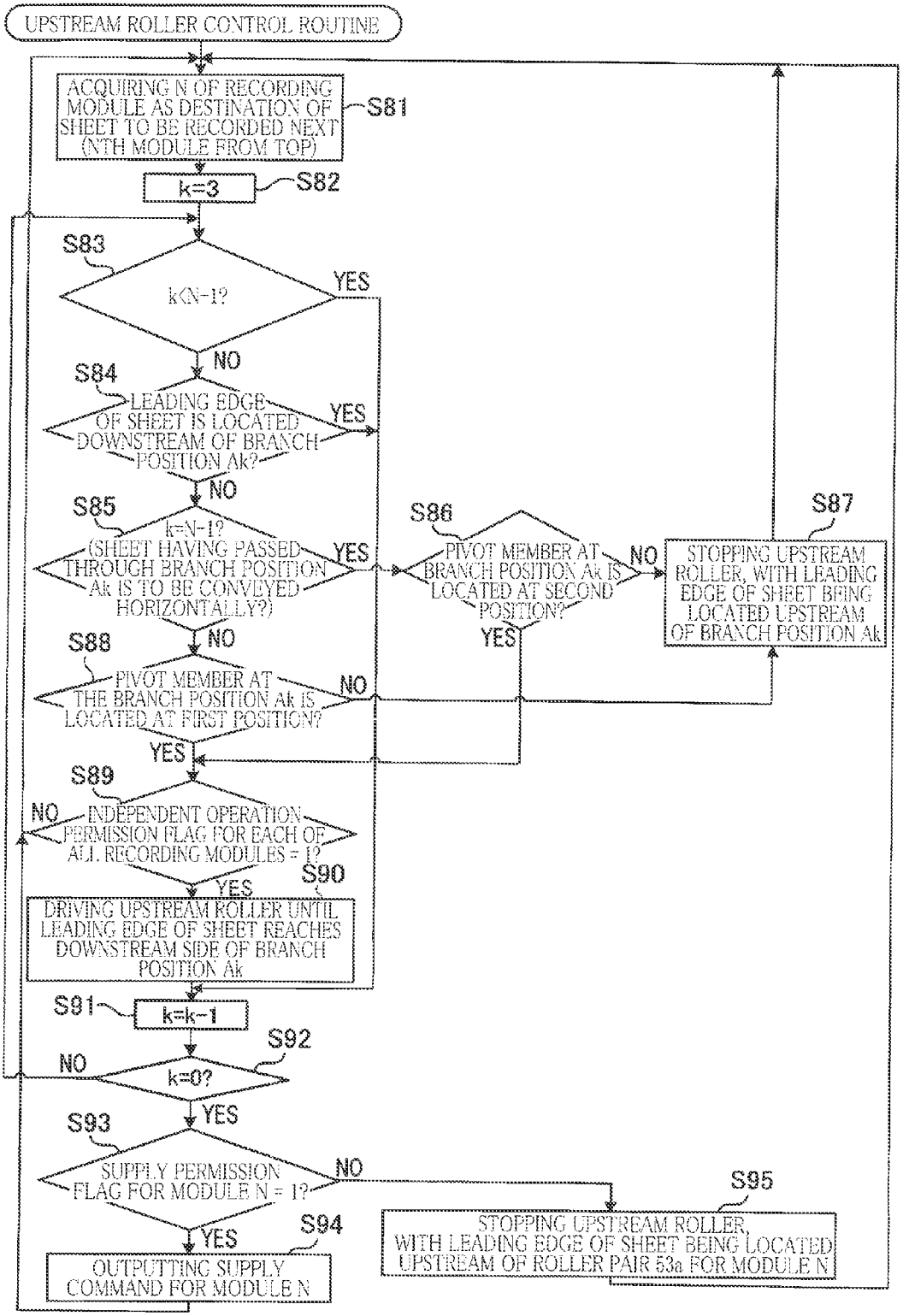
FIG. 10 is a flow chart illustrating an upstream roller control routine to be executed by the controller of the printer illustrated in FIG. 1.

In the upstream roller control routine, as illustrated in FIG. 10, this flow begins with S81 at which the controller 100 acquires the number N of the recording module as a destination of supply of the sheet P on which recording is to be performed next.

After S81, the controller 100 at S82 sets the variable k to 3 (k=3). After S82, the controller 100 at S83 determines whether the variable k is smaller than the variable N−1 (k<N−1) or not. That is, the controller 100 determines whether or not the sheet P on which recording is to be performed next is not to pass through the branch position Ak. When the variable k is smaller than the variable N−1 (S83: YES), that is, when the sheet P on which recording is to be performed next is not to pass through the branch position Ak, this flow goes to S91.

When the variable k is not smaller than the variable N−1 (S83: NO), that is, when the sheet P on which recording is to be performed next is to pass through the branch position Ak, as in the processing at S13, the controller 100 at S84 determines, based on the signal output from the first sensor 5, whether the leading edge of the sheet P is located downstream of the branch position Ak on the corresponding path or not.

When the leading edge of the sheet P is located downstream of the branch position Ak on the corresponding path (S84: YES), this flow goes to S91. When the leading edge of the sheet P is not located downstream of the branch position Ak on the corresponding path (S84: NO), the controller 100 at S85 determines whether or not the variable k is equal to the variable N−1 (k=N−1). That is, the controller 100 determines whether the sheet P on which recording is to be performed next is to pass through the branch position Ak and thereafter is to be conveyed horizontally to the corresponding module path or not.

When the variable k is equal to the variable N−1 (S85: YES), that is, when the sheet P on which recording is to be performed next is to be horizontally conveyed to the corresponding module path after passing through the branch position Ak, the controller 100 at S86 determines whether the one of the pivot members 28*a*1-28*c*1 which is provided at the branch position Ak is located at the second position or not. When the one of the pivot members 28*a*1-28*c*1 which is provided at the branch position Ak is located at the second position (S86: YES), this flow goes to S89. When the one of the pivot members 28*a*1-28*c*1 which is provided at the branch position Ak is not located at the second position (S86: NO), the controller 100 at S87 controls the upstream conveying motor 26M to stop the upstream rollers in a state in which the leading edge of the sheet P is located upstream of the branch position Ak on the corresponding path. After S87, this flow returns to S81.

When the variable k is not equal to the variable N−1 (S85: NO), that is, when the sheet P on which recording is to be performed next is not to be horizontally conveyed to the corresponding module path after passing through the branch position Ak, the controller 100 at S88 determines whether the one of the pivot members 28*a*1-28*c*1 which is provided at the branch position Ak is located at the first position or not. When the one of the pivot members 28*a*1-28*c* which is provided at the branch position Ak is not located at the first position (S88:

NO), this flow goes to S87. When the one of the pivot members 28*a*1-28*c*1 which is provided at the branch position Ak is located at the first position (S88: YES), the controller 100 at S89 determines whether the independent operation permission flag for each of all the recording modules 50*a*-50*d* is 1 or not.

When the independent operation permission flag for each of all the recording modules 50*a*-50*d* is not 1 (that is, when the independent operation permission flag for at least one of the recording modules 50*a*-50*d* is 0) (S89: NO), this flow returns to S81. When the independent operation permission flag for each of all the recording modules 50*a*-50*d* is 1 (S89: YES), the controller 100 at S90 controls the upstream conveying motor 26M to drive the upstream rollers until the leading edge of the sheet P reaches a downstream side of the branch position Ak on the corresponding path.

After S90, the controller 100 at S91 sets the variable k to k−1 (k=k−1) and at S92 determines whether the variable k is equal to zero (k=0) or not. When the variable k is not equal to zero (S92: NO), this flow returns to S83. When the variable k is equal to zero (S92: YES), the controller 100 at S93 determines whether the supply permission flag for the module N is 1 or not.

When the supply permission flag for the module N is 1 (S93: YES), the controller 100 at S94 outputs the supply command for the module N. When the supply permission flag for the module N is not 1 (S93: NO), the controller 100 at S95 controls the upstream conveying motor 26M to stop the upstream rollers in a state in which the leading edge of the sheet P is located upstream of the roller pair 53*a* for the module N on the corresponding path. After S94 or S95, this flow returns to S81.

With the above-described control, the position of each of the pivot members 28*a*1-28*c*1 provided at the respective branch positions A1-A3 is switched depending upon conveyance of the sheets P, and each of the sheets P is successively supplied to the corresponding one of the recording modules 50*a*-50*d*.

Figure 12:
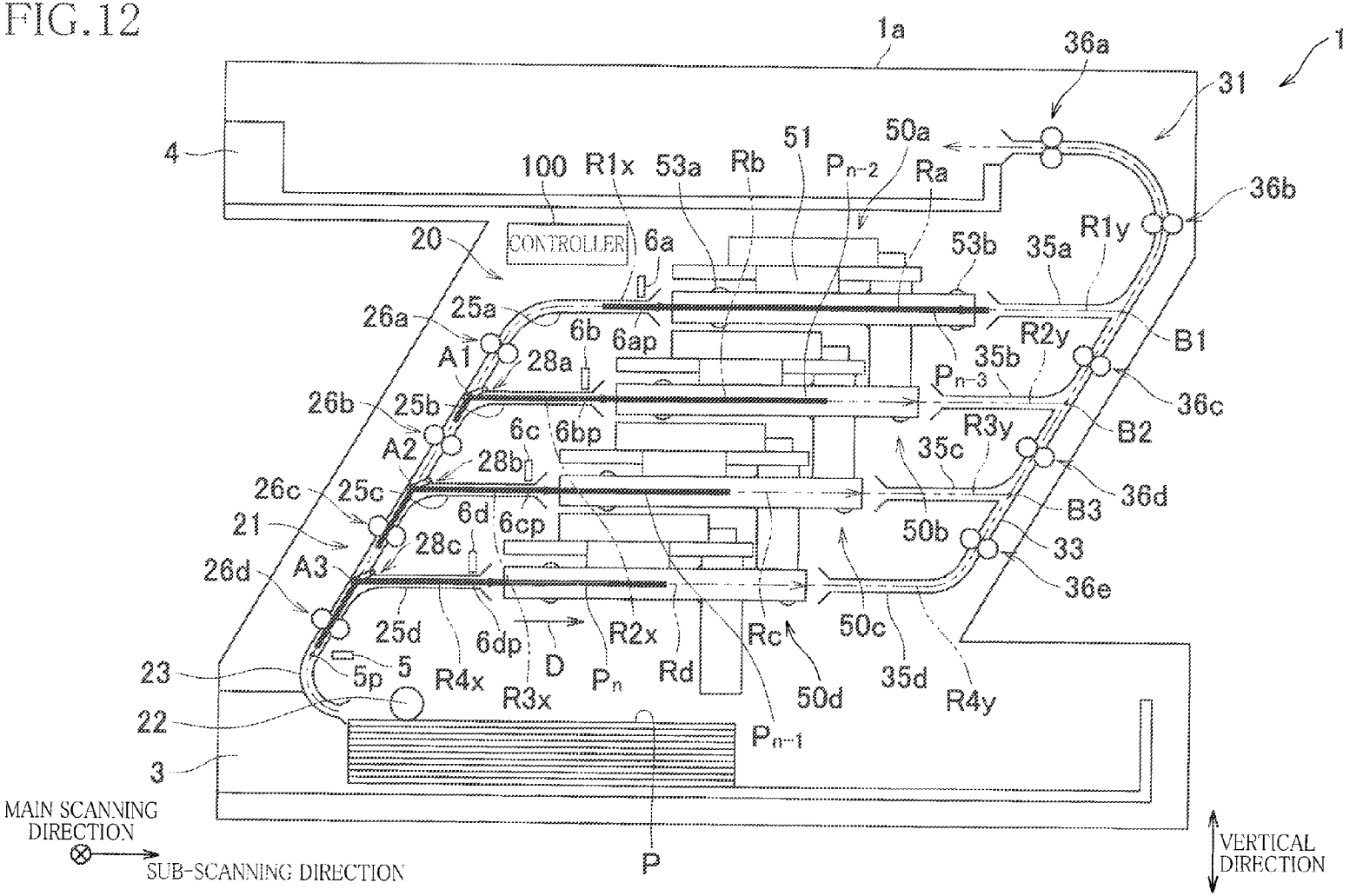
FIG. 12 is a schematic side view, corresponding to FIG. 1, illustrating a first stage of a situation in which a plurality of sheets of the A4 size or the letter size are successively supplied to recording modules.
Figure 13:
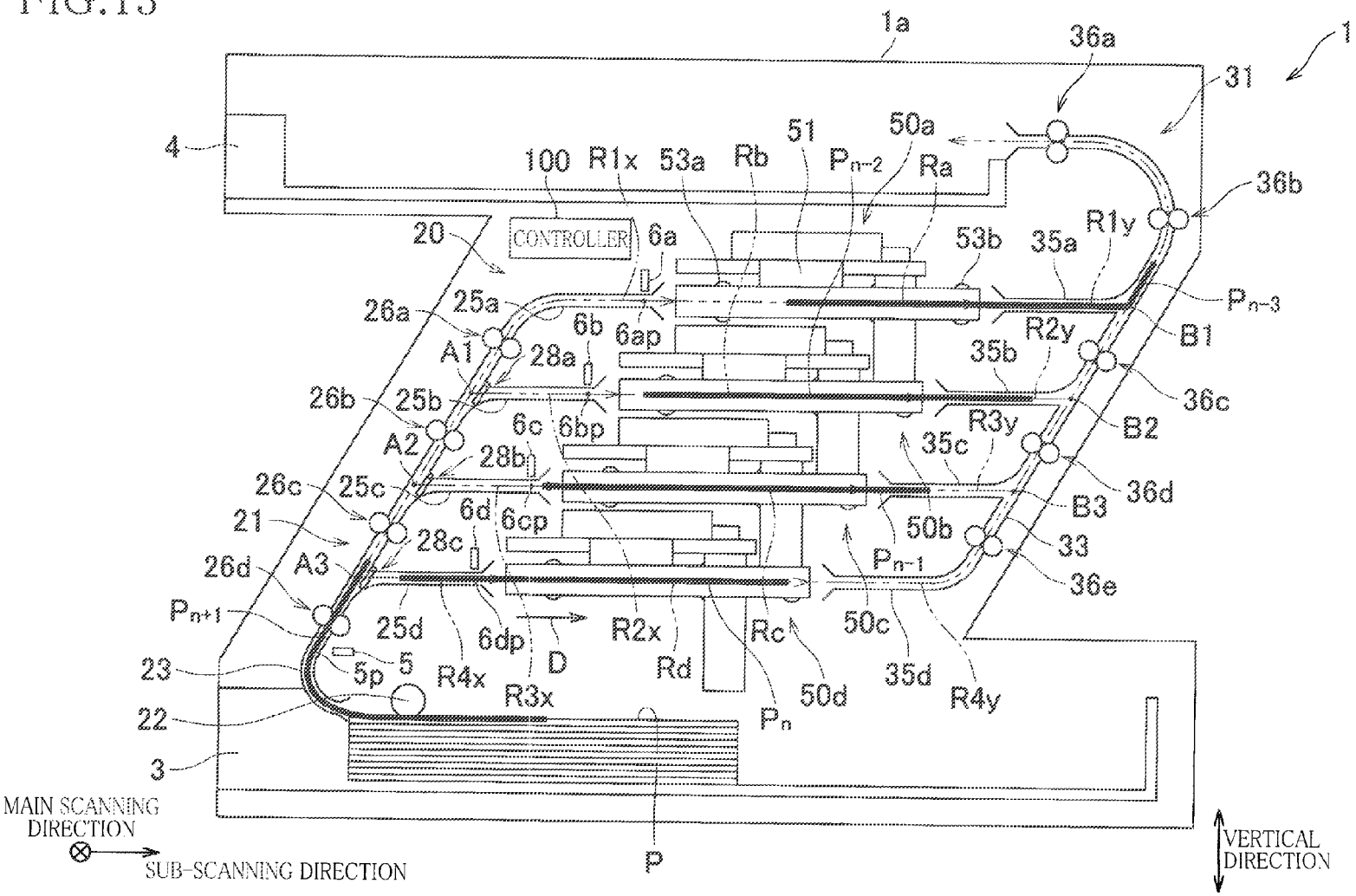
FIG. 13 is a schematic side view, corresponding to FIG. 1, illustrating a second stage of the situation in which a plurality of sheets of the A4 size or the letter size are successively supplied to the recording modules.

FIGS. 12 and 13 chronologically illustrate situations in which a plurality of sheets P of the A4 size or the letter size are successively supplied to the recording modules 50*a*-50*d*.

FIG. 12 illustrates a situation in which four sheets $P_{n-3}$, $P_{n-2}$, $P_{n-1}$, $P_n$ are respectively supplied to the recording modules 50*a*-50*d*. At this point in time, recording is being performed by the recording module 50*d* on a leading edge of a recordable area on the sheet $P_n$, and a trailing edge of the sheet $P_n$ is located upstream of the branch position A3 on the path R4x (a first requirement).

FIG. 13 illustrates a situation, following the stage illustrated in FIG. 12, in which the sheet $P_{n+1}$ being supplied from the sheet storage 3 is to be conveyed to the recording module 50*a*. At this point in time, recording is being performed by the recording module 50*a* on a trailing edge of a recordable area on the sheet $P_{n-3}$, and the trailing edge of the sheet $P_n$ on which recording is being performed by the recording module 50*d* is located downstream of the branch position A3 on the path R4x and the module path Rd of the recording module 50*d* (a second requirement). At this time, a leading edge of the sheet $P_{n+1}$ being supplied from the sheet storage 3 has passed through the branch position A3, and this sheet $P_{n+1}$ is being conveyed toward the recording module 50*a*. Here, the sign X represents the number of recording modules and the sign Y represents the number of reciprocating operations required for recording on the entire recordable area on the sheet P, and X is smaller than Y in the present embodiment (X=4 and Y=5). In FIG. 13, the Y−X+1+1th (i.e., second) reciprocating operation is performed by the recording module 50*d*.

The recordable area is a portion of the entire region on the recording medium (e.g., the sheet P) except a non-recordable area (i.e., margins) on which recording cannot be performed by the recording device (e.g., the head 51). This recordable area is determined not based on image data but based on settings of the recording apparatus (e.g., the printer 1), a recording mode, the recording medium, and the like. The first requirement and the second requirement are predicated upon a case where recording is performed on the entire recordable area, and these requirements are satisfied where the sheet P is any one of the A3 size, the A4 size, and the letter size.

In a mode, as one of the recording modes, in which margins are not formed (e.g., a borderless mode), an image slightly larger than the sheet P is recorded on the sheet P so as not to form any margins. In this case, the recording area outside the edges of the sheet P is included in the recordable area. In, e.g., calculation of the conveyance amount of the sheet P, the calculation can be performed in the same method as used in the case where margins are formed on the sheet P, assuming the length of the recording area outside the edges of the sheet P as a negative length of margins.

In the present embodiment, the processing at S18 corresponds to a determination processing, and the processings at S2 and S90 (hereinafter referred to as "processing at S2") correspond to a supply processing. Specifically, the processing at S18 at which the controller 100 determines whether or not the trailing edge of the sheet P on which recording is being performed by the recording module 50*d* is located downstream of the branch position A3 on the path R4x corresponds to the determination processing. The processing S2 at which, as illustrated in FIG. 13, the sheet $P_{n+1}$ being supplied from the sheet storage 3 is supplied to the recording module 50*a* along the path R1x via the shared portion of the paths R1x, R4x and the branch position A3 such that the leading edge of the sheet $P_{n+1}$ passes through the branch position A3 by the time the recording on the trailing edge of the recordable area on the sheet $P_{n-3}$ is completed by the recording module 50*a* corresponds to the supply processing. FIG. 11 also illustrates that the leading edge of the sheet $P_{n+1}$ being supplied from the sheet storage 3 passes through the branch position A3 by the time the recording on the trailing edge of the recordable area on the sheet $P_{n-3}$ is completed by the recording module 50*a*. That is, FIG. 11 illustrates that the leading edge of the fifth sheet passes through the branch position A3 by the time the fifth reciprocation (i.e., the last reciprocating operation) for the first sheet is completed. FIG. 11 also illustrates that the sheet $P_{n+1}$ being supplied from the sheet storage 3 is conveyed to the recording module 50*a* by the time the recording on the trailing edge of the recordable area on the sheet $P_{n-3}$ is completed by the recording module 50*a*. That is, FIG. 11 illustrates that the leading edge of the fifth sheet reaches the roller pair 53*a* of the recording module 50*a* by the time the fifth reciprocation (i.e., the last reciprocating operation) for the first sheet is completed.

In the present embodiment as described above, the path R4x and the module path Rd of the recording module 50*d* are defined so as to satisfy the first requirement (see FIG. 12). The path R4x is relatively short because of the first requirement, resulting in the reduced size of the printer 1. The path R4x and the module path Rd of the recording module 50*d* are defined so as to satisfy the second requirement (see FIG. 13). The second requirement can reduce a length of time in which the next sheet $P_{n+1}$ is kept waiting until the trailing edge of the sheet $P_n$ on which recording is being performed by the recording module 50*d* reaches a position located downstream of the branch position A3 on the path R4x and the module path Rd of the recording module 50*d*, thereby improving a throughput. Also, the supply processing S2 is executed based on the determination processing at S18, thereby improving the throughput while preventing a jam of the sheet P. That is, in the present embodiment, both of the downsizing of the printer 1 and the improvement of the throughput can be achieved.

Specifically, one example of the supply processing S2 based on the determination processing at S18 is the following. In the case where the sheet P is of the A4 size or the letter size, for example, the first sheet P is supplied to the recording module 50*a*, the second sheet P to the recording module 50*b*, the third sheet P to the recording module 50*c*, the fourth sheet P to the recording module 50*d*, and the fifth sheet P to the recording module 50*a*. Here, when the controller 100 determines that the trailing edge of the fourth sheet P supplied to the recording module 50*d* is located downstream of the branch position A3 on the path R4x (S18: YES), the controller 100 at S15 sets the first position permission flag for the pivot member 28*c*1 provided at the branch position A3 to 1. Based on this flag, the pivot member 28*c*1 is at S49 moved to the first position. Also, each of the pivot members 28*a*1, 28*b*1 is moved to the first position by the processings at S18, S20, and S45 for a corresponding one of the second and third sheets P. In the upstream roller control routine executed thereafter, since the fifth sheet P is supplied to the recording module 50*a* (N=1), the controller 100 determines that the sheet P is to pass through the branch positions A1-A3 (S83: YES) and at S94 outputs a supply command for the fifth sheet P. Based on this supply command, the fifth sheet P is at S2 supplied to the recording module 50*a*. That is, after the determination processing at S13 for the fourth sheet P, the independent operation permission flag for the module N is set to 1, and the supply command for the fifth sheet P is output based on this flag.

In a serial printer where the sheet P is intermittently conveyed as in the present embodiment, a waiting time tends to occur for a sheet P to be conveyed later among sheets P conveyed successively, which may make it difficult to improve the throughput. Since the present invention can improve the throughput, the present invention is particularly effective for the serial printer as in the present embodiment.

In the present embodiment, X (=4) is smaller than Y (=5). In this case, as illustrated in FIG. 13, the Y−X+1+1th (i.e., second) reciprocating operation is performed by the recording module 50*d* by the time the recording on the trailing edge of the recordable area on the sheet $P_{n-3}$ is completed by the recording module 50*a*. More specifically, FIG. 11 illustrates that the second reciprocation (the second reciprocating operation) is performed for the fourth sheet by the time the fifth reciprocation (i.e., the last reciprocating operation) for the first sheet is completed. This configuration can improve the throughput more effectively.

As illustrated in FIG. 1, the path R4x and the module path Rd of the recording module 50*d* are defined such that a distance L1, along the path R4x and the module path Rd of the recording module 50*d*, between the branch position A3 and a position Q opposite the most downstream one of the plurality of ejection openings 51*b* (see FIG. 3) of the recording module 50*d* is shorter than a distance L2, along the path R1x and the module path Ra of the recording module 50*a*, between the branch position A3 and a position Q opposite the most downstream one of the plurality of ejection openings 51*b* of the recording module 50*a*. The controller 100 executes control such that the sheet P is conveyed to the path R1x with a higher priority than the path R4x. With this configuration, an area not occupied by the sheet P in the shared portion of the paths R4x, R1x can be made relatively larger, reliably improving the throughput.

The path R4x and the module path Rd of the recording module 50*d* are defined so as to satisfy the first requirement and the second requirement in each of the case where the sheet P is of the A4 size and the case where the sheet P is of the letter size. With this configuration, particularly in a case where sheets P of widely used sizes such as the A4 size and the letter size are used, both of the downsizing of the printer 1 and the improvement of the throughput can be achieved.

The path R4x and the module path Rd of the recording module 50*d* are defined so as to satisfy the first requirement and the second requirement in the case where the sheet P is of the A3 size. With this configuration, both of the downsizing of the printer 1 and the improvement of the throughput can be achieved also in a case where the longest sheet is used.

Figure 14:
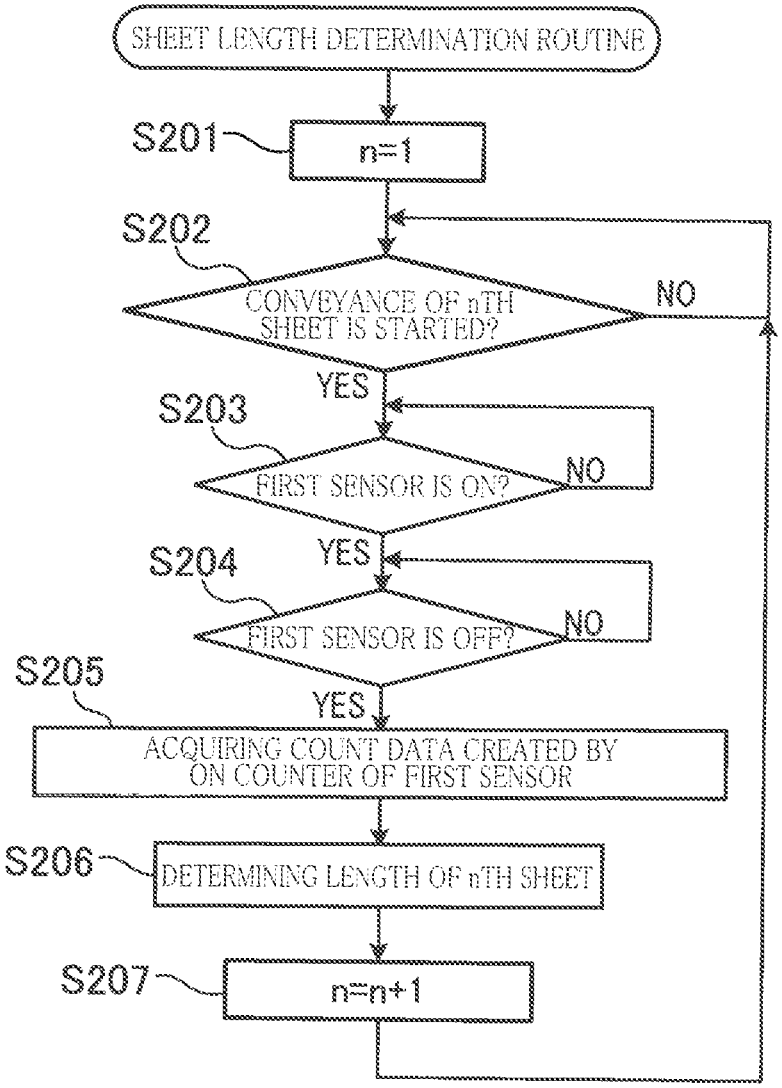
FIG. 14 is a flow chart illustrating a sheet length determination routine to be executed by a controller in an ink-jet printer according to a second embodiment of the present invention.

There will be next explained an ink-jet printer according to a second embodiment of the present invention with reference to FIG. 14.

The printer according to the second embodiment has the same construction as the printer 1 according to the first embodiment except for the processings executed by the controller 100. It is noted that the same reference numerals as used in the first embodiment are used to designate the corresponding elements of the second embodiment, and an explanation of which is dispensed with.

After determining the destination of supply of the sheet P, the controller 100 executes a sheet length determination routine (see FIG. 14) in parallel with the recording module control routine and other routines.

In the sheet length determination routine, the flow begins with S201 at which the controller 100 sets a variable n to one (n=1). After S201, the controller 100 at S202 determines whether conveyance of the nth sheet P is started or not based on a state of driving of the sheet-supply motor 22M. When the conveyance of the nth sheet P is not started (S202: NO), the controller 100 repeats the processing at S202.

When the conveyance of the nth sheet P is started (S202: YES), the controller 100 at S203 determines whether the ON signal has been output from the first sensor 5 or not. That is, the controller determines whether the leading edge of the nth sheet P has reached the first sensing position 5*p* or not. When the ON signal is not output from the first sensor 5 (S203: NO), the controller 100 repeats the processing at S203.

When the ON signal is output from the first sensor 5 (S203: YES), the controller 100 at S204 determines whether the OFF signal has been output from the first sensor 5 or not. That is, the controller determines whether the trailing edge of the nth sheet P has reached the first sensing position 5*p* or not. When the OFF signal is not output from the first sensor 5 (S204: NO), the controller 100 repeats the processing at S204.

When the OFF signal is output from the first sensor 5 (S204: YES), the controller 100 at S205 acquires the count data created by the ON counter of the first sensor 5. The controller 100 at S206 calculates and determines the length of the nth sheet P based on the acquired count data (a calculation processing). The controller 100 at S207 sets the variable n to n+1 (n=n+1), and this flow returns to S202.

In the present embodiment, the controller 100 executes the determination processings at S3, S13, S18, and S23 based on the signals output from the first sensor 5 and the second sensors 6*a*-6*d*. Specifically, the following processings are executed.

The controller 100 at S3 determines that the leading edge of the sheet P has reached the roller pair 53*a* of the module N (S3: YES), when the amount of conveyance of the sheet P from the point in time when the leading edge of the sheet P has reached the first sensing position 5*p* has reached the distance Lx and when the amount of conveyance of the sheet P from the point in time when the leading edge of the sheet P has reached the corresponding one of the second sensing positions 6*ap*-6*dp* has reached a distance or amount Lx2 along the corresponding path between the corresponding one of the second sensing positions 6*ap*-6*dp* and the roller pair 53*a*. The amount of conveyance of the sheet P from the point in time when the leading edge of the sheet P has reached the corresponding one of the second sensing positions 6*ap*-6*dp* is calculated based on the count data created by the ON counter of the corresponding one of the second sensors 6*a*-6*d*. In FIG. 1, the distance Lx2 represents a distance along the path R1x between the second sensing position 6*ap* to the roller pair 53*a* for the recording module 50*a*.

The controller 100 at S13 determines that the trailing edge of the sheet P is located downstream of the branch position Ak on the corresponding path (S13: YES), when the sum of (i) the amount of conveyance of the sheet P from the point in time when the leading edge of the sheet P has reached the corresponding one of the second sensing positions 6*ap*-6*dp* and (ii) a distance or amount Ly2 along the corresponding path between the branch position Ak and the corresponding one of the second sensing positions 6*ap*-6*dp* is greater than the length of sheet calculated at S206. This applies to the processing at S18. In FIG. 1, the distance Ly2 represents a distance along the path R1x between the branch position A1 and the second sensing position 6*ap*.

The controller 100 at S23 determines that the trailing edge of the sheet P is located downstream of the roller pair 53*a* on the corresponding path (S23: YES), when the amount of conveyance of the sheet P from the point in time when the leading edge of the sheet P has reached the corresponding one of the second sensing positions 6*ap*-6*dp* is greater than the sum of the length of sheet calculated at S206 and the distance Lx2.

In the present embodiment as described above, the controller 100 executes the determination processing at S13 based on the signals output from the first sensor 5 and the second sensors 6*a*-6*d*. If the controller executes the determination processing at S13 only based on the signal output from the first sensor 5, a mistake may be made in the determination in a case where the sheet P is not being appropriately conveyed due to skid or other causes. In the present embodiment as described above, however, the controller 100 executes the determination processing at S13 based on the signals output from the first sensor 5 and the second sensors 6*a*-6*d*, thereby reducing the possibility of mistake in the determination, resulting in improvement in reliability of the determination in the determination processing at S13. Since the skid easily occurs on a short sheet P in particular, the above-described configuration is particularly effective for the short sheet P.

Figure 15:
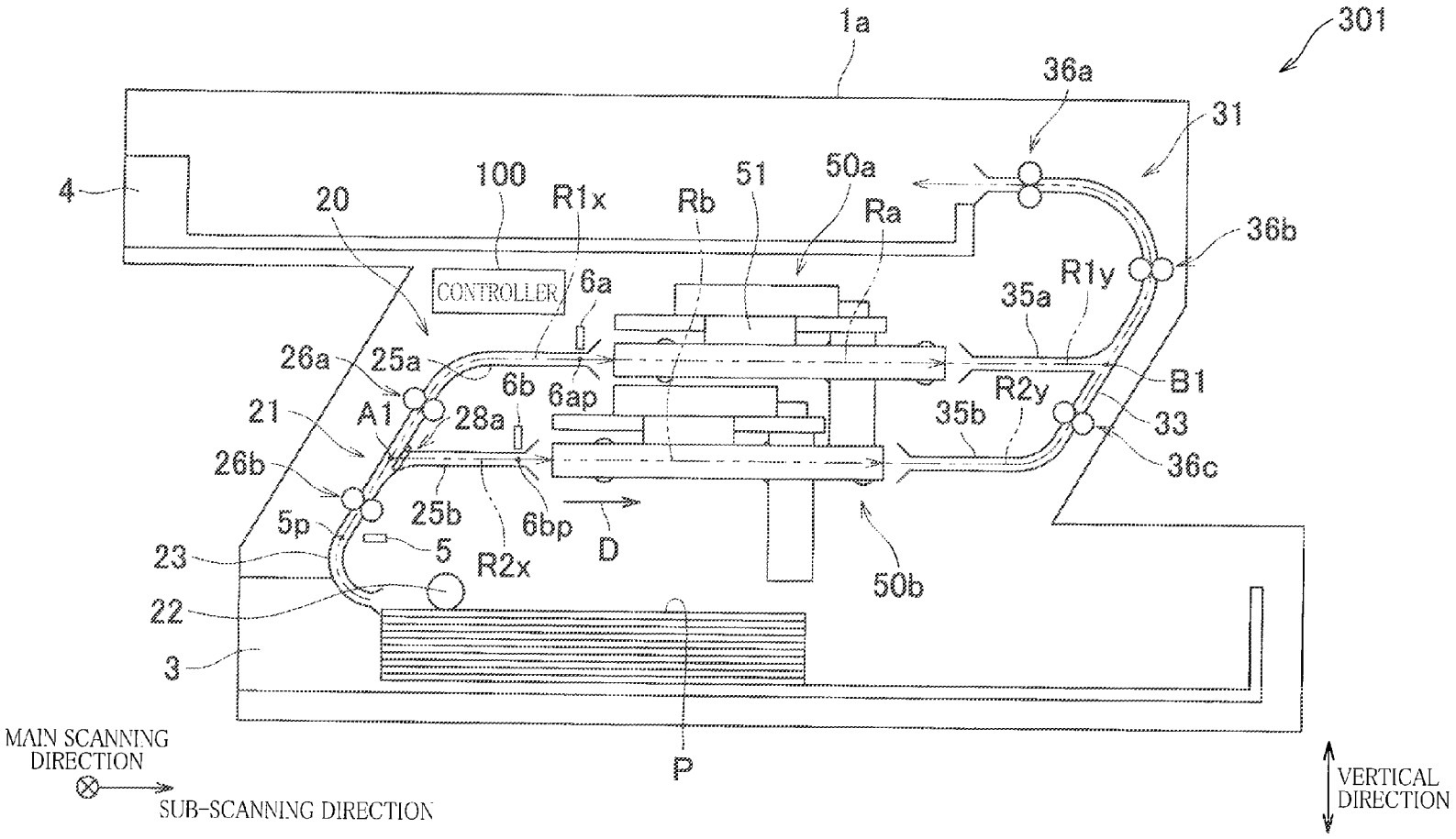
FIG. 15 is a schematic side view, corresponding to FIG. 1, illustrating an internal structure of an ink-jet printer according to a third embodiment of the present invention.

There will be next explained an ink-jet printer 301 according to the third embodiment of the present invention with reference to FIG. 15.

The printer 301 according to the third embodiment has the same construction as the printer 1 according to the first embodiment except for the number of recording modules and a construction of paths. It is noted that the same reference numerals as used in the first embodiment are used to designate the corresponding elements of the third embodiment, and an explanation of which is dispensed with.

The printer 301 includes two recording modules 50*a*, 50*b*. Two cartridges, not shown, are mountable on and removable from the housing 1*a*. The upstream unit 21 has two paths R1x, R2x through which the sheet P is conveyed from the sheet storage 3 to the respective module paths Ra, Rb formed in the respective recording modules 50*a*, 50*b*. The downstream unit 31 has two paths R1y, R2y through which the sheet P is conveyed from the downstream end portions of the respective module paths Ra, Rb to the sheet receiver 4.

Also in the third embodiment, the same construction as employed in the first embodiment can achieve the same effects as obtained in the first embodiment.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

The number of recording modules may be any number as long as a plurality of recording modules are provided. The recording modules are used in order from above in the above-described embodiment, but the present invention is not limited to this configuration. For example, the recording modules may be used in order from below and may be used in other orders.

The positional relationship between the recording modules is not limited in particular. For example, while the four recording modules 50*a*-50*d* are arranged at different positions in the sub-scanning direction in the above-described embodiment, the recording modules may be arranged without difference in positions in the sub-scanning direction, that is, the recording modules may be arranged at the same position in the sub-scanning direction. Two recording modules adjacent to each other in the vertical direction may be arranged at different positions in a direction, in the plane of the module paths, which differs from the sub-scanning direction (e.g., the main scanning direction). The plurality of recording modules may not be arranged in the vertical direction, and the plurality of recording modules may be arranged in the horizontal direction and may not be arranged in one direction.

Recording modules assumed to be the first recording module and the second recording module among the plurality of recording modules may be changed as needed according to, e.g., the construction of the paths. No recording module may be disposed between the first recording module and the second recording module as in the third embodiment.

The plurality of recording modules may have different constructions. For example, the plurality of recording modules may be different from each other in, e.g., recordable color, resolution, recording speed, recording method, type of recordable recording medium, and size of recordable recording medium.

The plurality of roller pairs constituting the individual conveyor may be driven by the same drive source and may be driven respectively by individual drive sources. In the above-described embodiment, the roller pair 53*b* may not be the one-way roller, and the roller pairs 53*a*, 53*b* may be driven in complete synchronization with each other.

The intersecting angle of a plurality of paths and the angle of a curved portion of one path may be any angles. For example, the guide 23 and each of the guides 25*a*-25*d* are not perpendicular to each other in the above-described embodiment but may be perpendicular to each other. Likewise, the guide 33 and each of the guides 35*a*-35*d* are not perpendicular to each other in the above-described embodiment but may be perpendicular to each other.

Relationship of position, angle, and so on between the plurality of paths may be any relationship. In the above-described embodiment, for example, the angles of the guide 23, 33 with respect to the vertical direction may or may not be the same as each other. The plurality of paths may not include a complete shared portion which is shared by all the paths. The number of paths and the construction of each path may be changed according to the number and/or arrangement of recording modules. Limitation on the length of the path (e.g., a first length and a second length) is not essential in the present invention.

The plurality of pivot members constituting the switcher may be driven by the same drive source and may be driven respectively by individual drive sources. The switcher may not include the pivot members used in the above-described embodiment. For example, the switcher may be configured to switch the path by applying an external force to the recording medium by, e.g., an electrostatic force or air without contacting the recording medium.

Each of the sensors may be any type of sensor such as an optical sensor, a mechanical sensor, and a magnetic sensor. The sensing position may be any position on the shared portion. For example, the sensing position may be located at the same position as the branch position. A plurality of sensors may be provided each as the first sensor 5 in the above-described embodiment. The second sensors 6*a*-6*d* in the above-described embodiment may be omitted.

Components constituting the shared conveyor may be changed depending upon the recording modules to be focused on, a construction of the shared portion, and the like. For example, in a case where the shared portion is short, the shared conveyor may be constituted by only the sheet-supply roller and the sheet-supply motor.

A calculating method in the determination processing may be changed as needed. For example, in a case where the first sensing position 5*p* is located at the branch position A3, a distance between the first sensing position 5*p* and the branch position A3 is zero. In this case, accordingly, the controller may determine, without calculating the conveyance amount, that the trailing edge of the sheet P is located downstream of the branch position A3 (S13: YES), at a point in time when the trailing edge of the sheet P has reached the first sensing position 5*p*.

When the controller has determined that the trailing edge of the recording medium is located downstream of the branch position in the determination processing, the controller may not always execute the supply processing.

The controller may execute the determination processing with reference to a predetermined position located downstream of the branch position on the first path. That is, the controller may determine, in the determination processing, that the trailing edge of the recording medium is located downstream of the branch position on the first path, when the trailing edge of the recording medium has reached the above-described predetermined position.

A higher priority may be given to any of the plurality of paths for conveyance of the recording medium. The controller may determine, at any timing, combination of the recording media and paths to which the recording media are to be conveyed. The timing is not limited to a point in time between the reception of the recording command and the start of the conveyance of the recording medium and may be a point in time after the recording operation is started (e.g., a point in time after a start of conveyance of the preceding recording medium or a point in time between the start of conveyance of the recording medium and a start of operation of the switcher). Recording may be performed on a first surface of the recording medium and a second surface of the recording medium which is a back side from the first surface (e.g., a front surface and a back surface of the sheet P).

The size of the longest recording medium is not limited to the A3 size and may be any size such as the postcard size, the A6 size, the A4 size, and the letter size. Some recording media storable in the sheet storage may not satisfy the requirements for the first path and the module path of the first recording module (i.e., the first requirement and the second requirement). The recording medium is not limited to the sheet and may be any recording medium.

Each of the sheet storage and the sheet receiver may be disposed any position. For example, the sheet receiver may be disposed at a position at which only a part of the plurality of recording modules is interposed between the sheet receiver and the sheet storage in a direction of the arrangement of the recording modules. The sheet storage and the sheet receiver may be disposed on the same side of the plurality of recording modules. The sheet storage and/or the sheet receiver may be disposed at a position not overlapping any of the recording modules in the direction of the arrangement of the recording modules. A recording-medium support surface of the sheet storage and/or the sheet receiver may be inclined with respect to the horizontal direction.

In the case where X is smaller than Y ($X<Y$), the $Y-X+1+1$th reciprocating operation may be performed by the first recording module when recording is being performed by the second recording module on the trailing edge of the recordable area on the recording medium. For example, in the first embodiment, as illustrated in FIG. 11, the fifth reciprocation (the last reciprocating operation) is performed for the first sheet after the second reciprocation (the second reciprocating operation) is performed for the fourth sheet, but the present invention is not limited to this configuration. The second reciprocation (the second reciprocating operation) may be performed for the fourth sheet during the fifth reciprocation (i.e., the last reciprocating operation) for the first sheet.

The above-described requirement for the reciprocating operation is not essential in the present invention. That is, X may be larger than or equal to Y ($X \geq Y$). Also, the $Y-X+1+1$th reciprocating operation may be performed by the first recording module after the recording on the trailing edge of the recordable area on the recording medium is completed by the second recording module.

The present invention is applicable not only to the serial printer but also to a line printer. The present invention is applicable not only to the ink-jet printing but also to laser printing, thermal transfer printing, and other similar printing.

The present invention is applicable not only to the printer but also to other devices such as a facsimile machine and a copying machine.

What is claimed is:

1. A recording apparatus, comprising:

a plurality of recording modules each comprising a module path and a recording device configured to perform recording on a recording medium conveyed along the module path, the plurality of recording modules comprising a first recording module and a second recording module different from the first recording module;

a storage configured to accommodate the recording medium;

a first path through which a recording medium is to be conveyed from the storage to the module path of the first recording module;

a second path through which a recording medium is to be conveyed from the storage to the module path of the second recording module, the second path comprising, at an upstream portion thereof, a shared portion shared with the first path, the second path being branched off from the first path at a branch position located at an end portion of the shared portion;

a switcher configured to switch, at the branch position, a destination of the recording medium between the first path and the second path;

a shared conveyor configured to convey the recording medium at the shared portion;

a sensor configured to output a signal indicating presence or absence of the recording medium at a sensing position located on the shared portion; and a controller configured to control the plurality of recording modules, the switcher, and the shared conveyor, the first path and the module path of the first recording module being configured such that a trailing edge of a recording medium for which recording is being performed by the first recording module on a leading edge of a recordable area is located upstream of the branch position on the first path, the first path and the module path of the first recording module being configured such that when recording is being performed by the second recording module on a trailing edge of a recordable area of a recording medium, the trailing edge of the recording medium on which the recording is being performed by the first recording module is located downstream of the branch position on the first path and the module path of the first recording module, the controller being configured to execute:

a determination processing in which the controller determines, based on the signal output from the sensor, whether the trailing edge of the recording medium on which the recording is being performed by the first recording module is located downstream of the branch position on the first path; and a supply processing in which when the controller has determined, in the determination processing, that the trailing edge of the recording medium is located downstream of the branch position on the first path, the controller controls the switcher and the shared conveyor to supply a recording medium from the storage to the second recording module along the second path via the shared portion and the branch position such that a leading edge of the recording medium passes through the branch position by a time the recording on the trailing edge of the recordable area of the recording medium is completed by the second recording module.

2. The recording apparatus according to claim 1, wherein the recording device comprises: a head formed with a plurality of ejection openings for ejecting liquid; a carriage supporting the head and configured to move the head in a first direction; and an individual conveyor configured to convey the recording medium along the module path in a second direction perpendicular to the first path, and wherein the controller is configured to control the plurality of recording modules to cause:

an intermittently conveying operation in which the individual conveyor intermittently conveys the recording medium in the second direction; and a reciprocating operation in which the carriage is moved in the first direction, and the liquid is ejected from the plurality of ejection openings in a conveyance stopped period in which conveyance of the recording medium is stopped during the intermittently conveying operation.

3. The recording apparatus according to claim 2, wherein when the number of recording modules is less than a reciprocating operation number which is the number of reciprocating operations required for recording on an entire recordable area on the recording medium, the reciprocating operation is performed by the first recording module a number of times which is obtained by adding one to a difference between the reciprocating operation number and the number of recording modules, by the time the recording on the trailing edge of the recordable area of the recording medium is completed by the second recording module.

4. The recording apparatus according to claim 1, wherein the first path and the module path of the first recording module are configured such that a first distance, along the first path and the module path of the first recording module, between the branch position and a position opposite a most downstream one of the plurality of ejection openings of the first recording module is less than a second distance, along the second path and the module path of the second recording module, between the branch position and a position opposite a most downstream one of the plurality of ejection openings of the second recording module, and wherein the controller is configured to convey the recording medium to the second path with greater priority than the first path.

5. The recording apparatus according to claim 1, wherein the first path and the module path of the first recording module are configured such that when the recording medium is of at least any of an A4 size and a letter size, the trailing edge of the recording medium for which the recording is being performed by the first recording module on the leading edge of the recordable area is located upstream of the branch position on the first path, and wherein the first path and the module path of the first recording module are configured such that when the recording is being performed by the second recording module on the trailing edge of the recordable area of the recording medium, the trailing edge of the recording medium on which the recording is being performed by the first recording module is located downstream of the branch position on the first path and the module path of the first recording module.

6. The recording apparatus according to claim 1, wherein the first path and the module path of the first recording module are configured such that when the recording medium is a longest recording medium whose length in a direction along the module path of the first recording module is greatest among a plurality of sizes of recording media accommodatable in the storage, the trailing edge of the recording medium for which the recording is being performed by the first recording module on the leading edge of the recordable area is located upstream of the branch position on the first path, and wherein the first path and the module path of the first recording module are configured such that when the recording is being performed by the second recording module on the trailing edge of the recordable area of the recording medium, the trailing edge of the recording medium on which the recording is being performed by the first recording module is located downstream of the branch position on the first path and the module path of the first recording module.

* * * * *